US009829230B2

(12) United States Patent
Tamaki et al.

(10) Patent No.: US 9,829,230 B2
(45) Date of Patent: Nov. 28, 2017

(54) AIR CONDITIONING APPARATUS

(71) Applicants: Shogo Tamaki, Tokyo (JP); Kazuyoshi Shinozaki, Cypress, CA (US); Tomohiko Kasai, Cypress, CA (US)

(72) Inventors: Shogo Tamaki, Tokyo (JP); Kazuyoshi Shinozaki, Cypress, CA (US); Tomohiko Kasai, Cypress, CA (US)

(73) Assignee: Mitsubishi Electric Corporation, Tokyo (JP)

( * ) Notice: Subject to any disclaimer, the term of this patent is extended or adjusted under 35 U.S.C. 154(b) by 940 days.

(21) Appl. No.: 13/780,037

(22) Filed: Feb. 28, 2013

(65) Prior Publication Data

US 2014/0238060 A1 Aug. 28, 2014

(51) Int. Cl.

*F25B 49/02* (2006.01)
*F25B 49/00* (2006.01)
*F25B 13/00* (2006.01)

(52) U.S. Cl.

CPC ..... *F25B 49/02* (2013.01); *F25B 49/00* (2013.01); *F25B 13/00* (2013.01); *F25B 2313/02741* (2013.01); *F25B 2313/0311* (2013.01); *F25B 2313/0314* (2013.01); *F25B 2313/0315* (2013.01); *F25B 2400/13* (2013.01); *F25B 2400/23* (2013.01); *F25B 2700/1931* (2013.01); *F25B 2700/1933* (2013.01)

(58) Field of Classification Search

CPC .. F25B 49/00; F25B 49/02; F25B 2313/0312; F24F 2011/0052; F04C 2270/80

USPC ..... 62/77, 149, 174, 292, 129, 225

See application file for complete search history.

(56) References Cited

U.S. PATENT DOCUMENTS 4,381,549 A * 4/1983 Stamp, Jr. ..... F24D 19/1039 165/11.1
4,660,386 A * 4/1987 Hansen ..... F25B 49/005 62/126
5,623,834 A * 4/1997 Bahel ..... F25B 49/005 62/131
6,826,454 B2 * 11/2004 Sulfstede ..... G05B 23/0235 700/276
2002/0040280 A1 * 4/2002 Morgan ..... B60H 1/00585 702/114
2004/0025525 A1 * 2/2004 Kubo ..... B60H 1/00385 62/230

(Continued)

FOREIGN PATENT DOCUMENTS

CN 1926392 A 3/2007
EP 2204621 A2 7/2010

(Continued)

OTHER PUBLICATIONS

International Search Report dated May 14, 2014 n corresponding PCT application PCT/JP2014/001053.

(Continued)

*Primary Examiner* — Frantz Jules
*Assistant Examiner* — Meraj A Shaikh
(74) *Attorney, Agent, or Firm* — Posz Law Group, PLC

(57) ABSTRACT

An air-conditioning apparatus has different two modes including a response detection diagnosis in which a control unit diagnoses a trouble of a component device during the trouble diagnosis operation based on presence or absence of a response from the operational state sensor when the mode has forcibly changed the device operation, and a performance detection diagnosis in which a trouble is detected by a detection value of the operational state sensor at a time when the operational state of the trouble diagnosis operation is stable, and the performance detection diagnosis is executed after the response detection diagnosis is executed.

10 Claims, 5 Drawing Sheets

(56) References Cited

U.S. PATENT DOCUMENTS

| | | | | |
|---|---|---|---|---|
| 2005/0126190 | A1* | 6/2005 | Lifson | F25B 49/005 62/129 |
| 2007/0204635 | A1* | 9/2007 | Tanaka | F25B 13/00 62/129 |
| 2008/0078189 | A1 | 4/2008 | Ando | |
| 2008/0196421 | A1 | 8/2008 | Rossi et al. | |
| 2010/0174412 | A1* | 7/2010 | Kwon | F24F 11/0009 700/275 |
| 2011/0154834 | A1* | 6/2011 | Choi | F24F 11/0009 62/56 |
| 2012/0072029 | A1* | 3/2012 | Persaud | G06N 5/04 700/276 |
| 2012/0174412 | A1* | 7/2012 | Ho | B26B 5/001 30/152 |

FOREIGN PATENT DOCUMENTS

| | | | |
|---|---|---|---|
| JP | 2002-089979 | A | 3/2002 |
| JP | 2005-049001 | A | 2/2005 |
| JP | 2006-313057 | A | 11/2006 |
| JP | 2008-082654 | A | 4/2008 |
| JP | 2010-127568 | A | 6/2010 |
| JP | 2010-151397 | A | 7/2010 |
| JP | 2012-017886 | A | 1/2012 |
| JP | 2012-132601 | A | 7/2012 |

OTHER PUBLICATIONS

Written Opinion of the International Searching Authority dated May 14, 2014 in corresponding PCT application PCT/JP2014/001053.
Office Action dated Apr. 29, 2016 issued in corresponding CN patent application No. 201480011084.7 (and English translation).
Japanese Office Action dated Aug. 16, 2016 in the corresponding JP application No. 2015-539894. (English translation attached.).
CN Office Action dated Oct. 31, 2016 in the corresponding CN application No. 201480011084.7 (English translation attached.).
Office Action dated Apr. 1, 2017 issued in corresponding CN patent application No. 201480011084.7 (and English translation).

* cited by examiner

AIR CONDITIONING APPARATUS

TECHNICAL FIELD

The present invention relates to an air-conditioning apparatus of vapor compression scheme, to which at least one heat source unit and a plurality of use units are connected. Specifically, the present invention relates to an air-conditioning apparatus that can automatically detect malfunctioning parts of the air-conditioning apparatus.

BACKGROUND ART

Conventionally, there have been air-conditioning apparatuses configured by connecting a plurality of use units via a refrigerant extension pipes to at least one heat source unit. Where there is abnormality in the operational state of such an air-conditioning apparatus, or in the case of periodical inspection, a worker visits the installation place and performs mending and repair of the malfunctioning parts. However, since an air-conditioning apparatus is composed of many parts, search for malfunctioning parts greatly relies on experiences or ability of the workers, and in many cases a prolonged time is required to identify the malfunctioning parts. In order to achieve an improved maintenance and service organization, it is essential to identify malfunctioning parts in a short time. Therefore, many methods have been developed so far for searching malfunctioning parts.

As such methods, a technique is disclosed that maintains a motor rotation speed at a constant value to yield the constant state of a refrigerant at the inlet and the outlet of the compressor, and maintains a constant rotation speed of an outdoor unit fan to achieve a constant degree of heat exchange at a condenser. This technique thereby calculates a refrigerant amount ratio accurately (see, for example, Patent Literature 1).

Further, a technique is disclosed that determines the amount of refrigerant within a refrigerant circuit by: stabilizing a flow rate of the refrigerant suctioned and discharged by a compressor by implementing a constant compressor rotation speed control; and controlling an indoor expansion valve to achieve a constant degree of superheating so that the amounts of refrigerant at the indoor heat exchanger and a gas refrigerant communication pipes become constant (for example, see Patent Literature 2).

Further, a technique is disclosed in which an indoor unit is connected to a branching unit having an electromagnetic expansion valve via each branching port of the branching unit, all indoor units drive in a heating operation, and correspondence between the pipes and wiring of the indoor units and branching units are detected by closing the electromagnetic expansion valves one by one (for example, see Patent Literature 3).

CITATION LIST

Patent Literature

Patent Literature 1 Japanese Unexamined Patent Application No. 2012-132601 (see FIG. 4, etc.)

Patent Literature 2 Japanese Unexamined Patent Application No. 2006-313057 (see FIG. 9, etc.)

Patent Literature 3 Japanese Unexamined Patent Application No. 2012-017886 (see FIG. 10, etc.)

SUMMARY

Technical Problem

However, the descriptions of the techniques in Patent Literatures 1-3 merely disclose methods for diagnosis for each of the diagnoses, and there is no disclosure on which one of the diagnoses to perform first or in an earlier order in a case where the malfunctioning parts are not identified on the installation place. Further, with the techniques described in Patent Literature 1-3, where multiple target portions are subjected to trouble diagnosis, each diagnosis takes time, resulting in an extended time for trouble part identification. Further, the descriptions of the techniques in Patent Literature 1-3 have no disclosure on what operational state to achieve by items of diagnosis.

The present invention is made to overcome the above-stated problems, and an object of the present invention is to obtain an air-conditioning apparatus that can optimize the order of the diagnosis, automatically specify a malfunctioning portion in a short time and with high accuracy by executing a trouble diagnosis operation optimal for trouble detection with a method for diagnosis.

Solution to Problem

An air-conditioning apparatus according to the present invention comprises: a refrigerant circuit in which a compressor, a heat source side heat exchanger, a use side pressure reducing mechanism, a use side heat exchanger are connected by a pipe such that a refrigerant circulates therearound; an operational state sensor that detects at least one of a refrigerant temperature and a refrigerant pressure; a controller control device that includes a diagnostic operation instruction unit that instructs execution of a trouble diagnosis operation for specifying a trouble of a component device of the air-conditioning apparatus, and a determination unit that determines presence or absence of the trouble; and a unit control device including a control unit that performs control of each device during the trouble diagnosis operation, wherein the control unit has diagnosis modes for trouble diagnosis of the component device during the trouble diagnosis operation, the diagnosis modes including: a response detection diagnosis mode that detects that there is a trouble in a case where the response detection diagnosis mode forcibly changes device operation and then a change in a detection value of the operational state sensor is within a predetermined range of value, or a magnitude of the change in the detection value is equal to or smaller than a threshold value; and a performance detection diagnosis mode that detects a trouble based on a detection value of the operational state sensor in a case where the operational state of the trouble diagnosis operation is stable, wherein the performance detection diagnosis mode is executed after the response detection diagnosis mode is executed.

Advantageous Effect

According to the air-conditioning apparatus of the present invention, it becomes possible to automatically specify malfunctioning portions in a short time and with high accuracy even when portions with troubles have been unidentified.

DESCRIPTION OF EMBODIMENTS

Hereafter, embodiments of the present invention will be described based on the drawings. Including FIG. 1, some relationships of sizes or scales may be different from the actual configuration in the accompanying drawings. Also, in the following drawings, including FIG. 1, and explanations therefor, elements with same signs are identical or equivalent, and this commonly applies to the entire description herein. Further, the entire descriptions of the elements in the specification merely exemplifies embodiments of components. The scope of the present invention will not be confined within the description. In addition, the specification recites the units of amounts represented by various symbols in the paragraphs or numerical formulae. These units are indicated within square brackets ([ ]). Dimensionless amounts (amount with no units) are indicated by "[-]".

Embodiment 1

Figure 1:
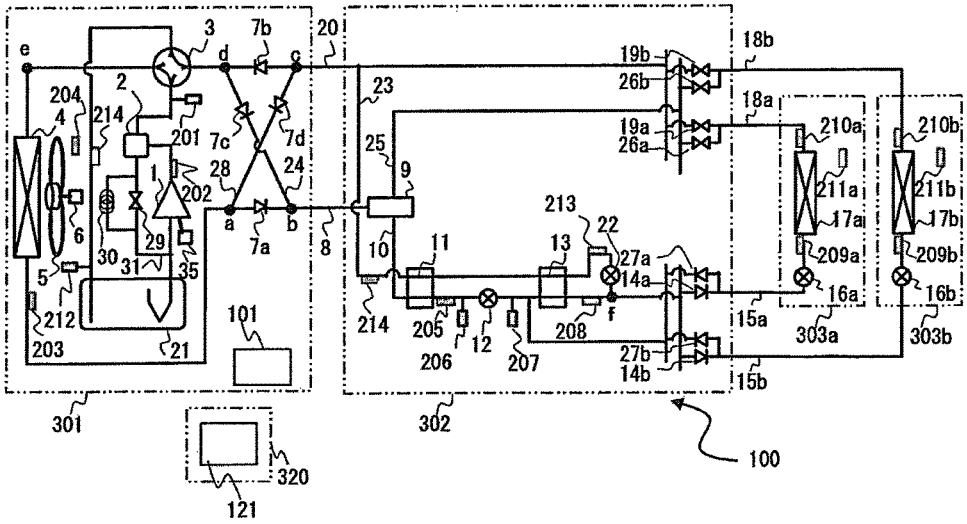
FIG. 1 is a schematic diagram showing a refrigerant circuit configuration of an air-conditioning apparatus according to Embodiment 1 of the present invention.
Figure 2:
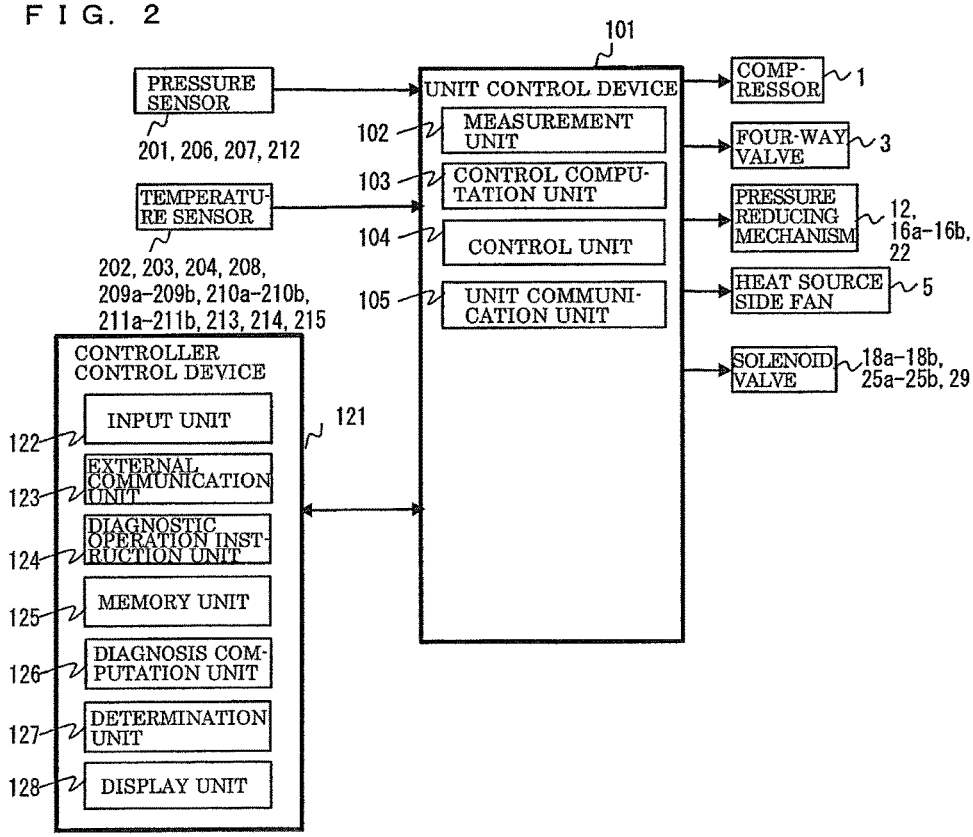
FIG. 2 is a block diagram showing an electrical configuration of a control device of an air-conditioning apparatus according to Embodiment 1 of the present invention.

FIG. 1 is a schematic diagram showing a refrigerant circuit configuration of an air-conditioning apparatus 100 according to Embodiment 1 of the present invention. FIG. 2 is a block diagram showing the configuration of a unit control device 101 and a controller control device 121 of the air-conditioning apparatus 100. Based on FIG. 1 and FIG. 2, the configuration of the air-conditioning apparatus 100 will be described.

This air-conditioning apparatus 100 is installed on a building or an apartment or a trade establishment, and can perform concurrent operation of cooling and heating by performing refrigeration cycle operation that circulates refrigerant in vapor compression system for air-conditioning to individually process cooling instructions (cooling ON/OFF) or heating instructions (heating ON/OFF) selected at the use units 303*a* and 303*b*.

Configuration of Air-Conditioning Apparatus 100

The air-conditioning apparatus 100 includes a heat source unit 301, a relay unit 302 and use units 303*a*, 303*b*. The heat source unit 301 and the relay unit 302 are connected with each other with a high pressure pipes 8 and a low-pressure pipe 20, which are refrigerant pipes. The relay unit 302 and the use units 303*a*, 303*b* are connected with each other with indoor liquid branch pipes 15*a*, 15*b* and indoor gas branch pipes 18*a*, 18*b*, which are refrigerant pipes. Some of the following explanations may refer to both of the use units 303*a*, 303*b* simply as a use unit 303.

Further, the air-conditioning apparatus 100 comprises a unit control device 101 that controls overall operations of the air-conditioning apparatus 100, and an external controller 320 that can convey instructions of the operation to the unit control device 101, and monitor the operational state. The external controller 320 may comprise, for example, a lap-top PC or a tablet-type portable terminal personal computer.

In Embodiment 1, as shown in FIG. 1, a configuration in which two use units 303*a*, 303*b* are connected to one heat source unit 301 via a relay unit 302 will be described. However, the number of units are not specifically limited. For example, there are similarly practicable embodiments to which two or more heat source units 301, two or more relay units 302, and three or more use units 303 are connected. Further, the refrigerant for use in the air-conditioning apparatus 100 is not specifically limited. For example, R410A, R407C, R404A, R32, HFO-1234yf, natural refrigerant (hydrocarbon, helium, carbon dioxide, etc.) may be employed.

<Heat Source Unit 301>

The heat source unit 301 is installed, for example, outdoors, and supplies refrigerant to the use units 303*a*, 303*b* according to operation requested at the use units 303*a*, 303*b*. The heat source unit 301 includes a compressor 1, a compressor invertor 35, an oil separator 2, a four-way valve 3, a heat source side heat exchanger 4, a heat source side fan 5, a fan motor 6, a check valve block 7(check valve 7*a*-7*d*, pipe 24, pipe 28), an accumulator (liquid receiver) 21, a pipe 31, a capillary 30 and a solenoid valve 29.

The compressor 1, sucks and compresses the refrigerant to render the refrigerant in a high-temperature, high-pressure state. The compressor invertor 35 can set the value of the operation frequency compressor 1 to a predetermined value, and can control the value to be any value.

The oil separator 2 has a function to separate oil from the refrigerant flowing out of the compressor 1 and flow the oil in the direction of the pipe 31, and flow the refrigerant in the direction of the four-way valve 3. The oil separator 2 is not requisite.

The four-way valve 3 is a valve for switching the direction of the flow of the refrigerant, and includes the first to fourth ports. The first port is connected to the discharge side of the compressor 1, the second port is connected to the side of the heat source side heat exchanger 4, the third port is connected to the suction side of the compressor 1, and the fourth port is connected to the low-pressure pipe 20. The four-way valve 3 is configured to allow switching between a state in which, while the first port and the second port communicate with each other, the third port and the fourth port are closed (the state shown by the solid line in FIG. 1), and a state in which while the third port and the fourth port establish communication, the first port and the second port are closed (the state shown by dashed lines in FIG. 1). The four-way valve 3 is not requisite when only one of cooling operation and heating operation are utilized.

The heat source side heat exchanger 4 is a fin-and-tube type heat exchanger of cross fin scheme, composed, for example, of a heat-transfer pipe and multiple fins, and exchanges heat between a heat medium, such as outdoor air, and the refrigerant. The heat source side heat exchanger 4 serves as an evaporator in heating operation, and serves as a condenser at the cooling operation.

The heat source side fan 5 supplies air to the heat source side heat exchanger 4, and is configured of a propeller fan or the like. The heat source side fan 5 may be installed near the heat source side heat exchanger 4.

The fan motor 6, e.g. a DC fan motor, drives the heat source side fan 5 and can vary the flow rate of air.

The check valve block 7 is provided to control the direction of flow of the refrigerant. The check valve block 7 includes a pipe 24 and a pipe 28. The pipe 24 connects a junction point d that is between the four-way valve 3 and the check valve 7*b*, and a junction point b that is between the check valve 7*a* and the high pressure pipes 8. The pipe 28 connects a junction point c that is between the check valve 7*b* and the low-pressure pipe 20, and a junction point a that is between the check valve 7*a* and the heat source side heat exchanger 4. The check valve 7*a* allows flow of refrigerant only in the direction from the junction point a to the junction point b, and the check valve 7*b* allows flow of the refrigerant only in the direction from the junction point c to the junction point d. The check valve 7*c* installed in the pipe 24 allows flow of the refrigerant only in the direction from the junction point d to the junction point b, and the check valve 7*d* installed on the pipe 28 allows flow of the refrigerant only in the direction from the junction point c to the junction point a. The check valve block 7 is not requisite.

The accumulator 21 is provided to the suction side of the compressor 1 and has a function to pool refrigerant excessive for operation of the air-conditioning apparatus 100, and a function to prevent a lot of liquid refrigerant from flowing into the compressor 1 by retaining the liquid refrigerant that is temporarily generated when the operational state changes.

The pipe 31 connects the oil separator 2 and the suction side of the compressor 1.

The solenoid valve 29 is provided to the pipe 31, and has a function to flow oil between the suction part of the compressor 1 and the accumulator 21 by way of a pipe 31 at activation. The solenoid valve 29 has a function to prevent extreme reduction in the low-pressure-side pressure at activation, by flowing the refrigerant to the pipe 31.

Further, the solenoid valve 29 has a function to achieve appropriate range of high-pressure-side pressure by bypassing the refrigerant to the low-pressure side when the high-pressure-side pressure rises.

The capillary 30 is provided in parallel with the solenoid valve 29, and has a function to, during operation, reduce the pressure of the oil having passed through the pipe 31 and flow the oil to the suction part of the compressor.

In the heat source unit 301, a pressure sensor 201 is provided on the discharge side of the compressor 1, a pressure sensor 212 is provided in the upstream of the accumulator 21. These sensors measure refrigerant pressures at the positions where they are installed.

Further, in the heat source unit 301, the temperature sensor 202 is provided on the discharge side of the compressor 1, the temperature sensor 203 is provided on the liquid side of the heat source side heat exchanger 4, and the temperature sensor 215 is provided in the upstream side of the accumulator 21. These sensors measure refrigerant temperatures at the locations they are installed.

Further, a temperature sensor 204 is provided at the air inlet of the heat source unit 301, and measures the outdoor air temperature.

Further, a unit control device 101 is provided in the heat source unit 301, and information on the measurement by each sensor provided for the heat source unit 301 is sent to the unit control device 101. The unit control device 101 will be described in detail later.

<Relay Unit 302>

The relay unit 302 is installed, for example, indoors and control the flow of the refrigerant according to the operations requested at the use units 303*a*, 303*b*. The relay unit 302 includes a gas-liquid separator 9, solenoid valves 19*a*, 19*b*, solenoid valves 26*a*, 26*b*, check valves 14*a*, 14*b*, check valves 27*a*, 27*b*, a supercooling heat exchanger 11, a supercooling heat exchanger 13, a liquid pressure reduction mechanism 12, a bypass pressure reduction mechanism 22, a pipe 10, a pipe 23 and a pipe 25.

The pipe 10 connects between the gas-liquid separator 9 and the supercooling heat exchanger 11.

The pipe 23 connects between the high-pressure side outlet of the supercooling heat exchanger 13 and the check valves 14*a*, 14*b*, and between the low-pressure pipe 20 and the solenoid valves 19*a*, 19*b*.

The pipe 25 connects between the gas-liquid separator 9 and the solenoid valves 26*a*, 26*b*.

The gas-liquid separator 9 separates the refrigerant having flowed the high pressure pipes 8 into the gas refrigerant and the liquid refrigerant. The liquid refrigerant separated at the gas-liquid separator 9 flows to the pipe 10, and the gas refrigerant flows to the pipe 25.

The solenoid valves 19*a*, 19*b* and the solenoid valves 26*a*, 26*b* control the direction of flow of the refrigerant for the use units 303*a*, 303*b* to which they are connected. One side of each of the solenoid valves 19*a*, 19*b* is connected to the low-pressure pipe 20, and the other side is connected to the corresponding one of the use units 303*a*, 303*b*. One side of each of the solenoid valves 26*a*, 26*b* is connected to the pipe 25, and the other side thereof is connected to the corresponding one of the use units 303*a*, 303*b*.

The check valves 14*a*, 14*b* allow the refrigerant to flow only in the direction from the supercooling heat exchanger 13 to the indoor liquid branch pipes 15*a*, 15*b*.

The check valves 27*a*, 27*b* allow the refrigerant to flow only in the direction from the indoor liquid branch pipes 15*a*, 15*b* to the supercooling heat exchanger 13.

The supercooling heat exchanger 11 comprises a double tube heat exchanger, in inside of which (upper side in FIG. 1) a low-pressure refrigerant having passed the bypass pressure reduction mechanism 22 flows and in outside of which (lower side in FIG. 1) the high pressure refrigerant having passed pipe 10 flows. The supercooling heat exchanger 11 exchanges heat between the high pressure refrigerant and the low-pressure refrigerant. The high pressure refrigerant is cooled and the low-pressure refrigerant is heated.

The supercooling heat exchanger 13 comprises a double tube heat exchanger, in inside of which (upper side in FIG. 1) a low-pressure refrigerant having passed the bypass pressure reduction mechanism 22 flows, and in outside of which (lower side in FIG. 1) a high pressure refrigerant having passed the liquid pressure reduction mechanism 12 or the check valves 27*a*, 27*b* flows. The supercooling heat exchanger 13 exchanges heat between the high pressure refrigerant and the low-pressure refrigerant, and the high pressure refrigerant is cooled and the low-pressure refrigerant is heated.

The liquid pressure reduction mechanism 12 and the bypass pressure reduction mechanism 22 can control the flow rate of refrigerant and can set the opening degree thereof variably.

In the relay unit 302, a pressure sensor 206 is provided between the high-pressure side of the supercooling heat exchanger 11 and the liquid pressure reduction mechanism 12, and a pressure sensor 207 is provided between the liquid pressure reduction mechanism 12 and the high-pressure side of the supercooling heat exchanger 13. These sensors measure the refrigerant pressure at the locations where they are installed.

Further, in the relay unit 302, a temperature sensor 205 is provided between the high-pressure side of the supercooling heat exchanger 11 and the liquid pressure reduction mechanism 12, a temperature sensor 208 is provided between the high-pressure side of the supercooling heat exchanger 13 and the check valves 14*a*, 14*b*, a temperature sensor 213 is provided on the outlet side of the bypass pressure reduction mechanism 22, and a temperature sensor 214 is provided between the side of the low-pressure side outlet of the supercooling heat exchanger 11. These sensors measure the refrigerant pressure at the installation locations.

The information on measurement by each sensor provided for the relay unit 302 is sent to the unit control device 101 of the heat source unit 301.

<Use Unit 303*a*, 303*b*>

The use units 303*a*, 303*b* are installed on the locations where cooling energy or heating energy can be supplied to the air-conditioning target space such as, indoor spaces, and performs cooling operation or heating operation for the air-conditioning target space. The use units 303*a*, 303*b* include use side pressure reduction mechanisms 16*a*, 16*b* and use side heat exchangers 17*a*, 17*b*. The use side pressure reduction mechanism 16*a* and the use side heat exchanger 17*a* are connected in series, and the use side pressure reduction mechanism 16*b* and the use side heat exchanger 17*b* are connected in series.

The use side pressure reduction mechanisms 16*a*, 16*b* can control the flow rate of the refrigerant, and can set the opening degree thereof variably.

The use side heat exchangers 17*a*, 17*b*, are fin-and-tube type heat exchangers of cross-fin scheme configured of, for example, a heat-transfer pipe and multiple fins, and exchange heat between the indoor air and the refrigerant. The use side heat exchangers 17*a*, 17*b* serve as condensers in the heating operation, and serve as evaporators in the cooling operation.

In the use units 303*a*, 303*b*, temperature sensors 209*a*, 209*b* are provided on the liquid sides of the use side heat exchangers 17*a*, 17*b*, respectively, and temperature sensors 210*a*, 210*b* are provided in the gas side of the use side heat exchangers 17*a*, 17*b*, respectively. The sensors measure refrigerant temperatures at the locations where they are installed.

Further, at the air inlets of the use units 303*a*, 303*b*, temperature sensors 211*a*, 211*b* are provided and measure air temperatures at the locations where they are installed.

The information on the measurement by each sensor provided for the use units 303*a*, 303*b* is sent to the unit control device 101 of the heat source unit 301.

Each of the temperature sensors or pressure sensors installed on the air-conditioning apparatus 100 has a function to serve as an operational state sensor that detects the corresponding one of the temperatures or the pressures of the refrigerant, respectively.

(Unit Control Device 101, Controller Control Device 121)

In the heat source unit 301, a unit control device 101 comprising a microcomputer, for example, is provided.

In the external controller 320, a controller control device 121 implemented with S/W, for example, is provided.

FIG. 2 is a block diagram showing the configuration of the unit control device 101 and the controller control device 121 of the air-conditioning apparatus 100. Based on FIG. 2, the unit control device 101 and the controller control device 121 will be described further in detail. FIG. 2 shows a connecting state of each of the sensors (pressure sensors (pressure sensors 201, 206, 207, 212), temperature sensors (temperature sensors 202-205, 208, 209*a*, 209*b*, 210*a*, 210*b*, 211*a*, 211*b*, 213-215)) and actuators (the compressor 1, the four-way valve 3, the pressure reducing mechanism (the liquid pressure reducing mechanism 12, the use side pressure reducing mechanisms 16*a*, 16*b*, the bypass pressure reducing mechanism 22), the heat source side fan 5, the solenoid valves 19*a*, 19*b*, solenoid valves 26*a*, 26*b*, and the solenoid valve 29, etc.).

In the unit control device 101, a measurement unit 102, a control computation unit 103, a control unit 104 and a unit communication unit 105 are provided.

Each of the amounts detected by each of the temperature sensors and the pressure sensors is input to the measurement unit 102. The information input to the measurement unit 102 is sent to the control computation unit 103. The control computation unit 103 performs computation to determine various control actions such as calculating a saturation temperature of the detection pressure based on the information input to the measurement unit 102. The control unit 104 is configured to control each device, such as, the compressor 1 and the heat source side fan 5 based on the result of computation by the control computation unit 103.

Further, the unit communication unit 105 receives input of communication data information from communication means such as telephone lines, LAN, wireless communication, and outputs the information to the outside. The unit communication unit 105 communicates a cooling instruction (cooling ON/OFF) output from a use side remote control (not shown), or a heating instruction (heating ON/OFF) to input the instructions to the unit control device 101, or communicates the measured value and the device control method with the controller control device 121.

In the controller control device 121, an input unit 122, an external communication unit 123, a diagnostic operation instruction unit 124, a memory unit 125, a diagnosis computation unit 126, a determination unit 127 and a display unit 128 are provided.

In the input unit 122, start instruction of trouble diagnosis operation and portions on which the worker intends to perform trouble diagnosis are input.

The external communication unit 123 receives input of communication data information via communications means, such as, a telephone line, LAN or wireless communication, and performs output of the information to the outside, and transmits input information from the input unit 122 or a device control method on a trouble diagnosis operation to the unit communication unit 105, and receives an operational state, such as a pressure or a temperature, from the unit communication unit 105.

The diagnostic operation instruction unit 124 determines the items of diagnosis for the trouble diagnosis operation based on the trouble diagnosis instruction input at the input unit 122 and an abnormality signal of the unit control device 101.

The storage unit 125 comprises, for example, a semiconductor memory, and stores a method for controlling each device on trouble diagnosis operation, a diagnosis procedure of each trouble diagnosis and parameters necessary for diagnosis.

The diagnosis computation unit 126 performs computation necessary for trouble diagnosis.

The determination unit 127 determines the presence or absence of trouble of the diagnosis portion and determines whether the operation state of the air-conditioning apparatus 100 is stable.

The display screen 128 is a display device, for example, a liquid crystal display device, mounted on the external controller 320, and displays the presence or absence of any trouble on the diagnosed portion and the operational state of the air-conditioning apparatus 100.

The unit control device 101 is disposed in the heat source unit 301. However, FIG. 1 merely shows an example of installation location. The installation location of the unit control device 101 is not specifically limited. For example, the unit control device 101 may be installed in the relay unit 302, use unit 303 and may be installed on the location separate from each unit.

Operation Mode of Air-Conditioning Apparatus 100

The air-conditioning apparatus 100 controls each device installed in the heat source unit 301, the use units 303*a*, 303*b* according to the air-conditioning instruction requested at the use units 303*a*, 303*b*. The air-conditioning apparatus 100 can, for example, perform a cooling only operation mode, in which both the use units 303*a*, 303*b* perform the cooling operation, a heating only operation mode in which both of the use units 303*a*, 303*b* performs heating operation, a cooling main operation mode in which while the use unit 303*a* performs cooling operation, a use unit 303*b* performs heating operation, and the cooling load is higher than the heating load, and a heating main operation mode in which while the use unit 303*a* performs cooling operation, the use unit 303*b* performs heating operation, and the heating load is higher than the cooling load. These operation modes are called as normal operation modes together.

(Normal Operation Mode: Cooling Only Operation Mode)

In the cooling only operation mode, the four-way valve 3 connects the discharge side of the compressor 1 to the gas side of the heat source side heat exchanger 4, and connects the suction side of the compressor 1 to the junction point d. The solenoid valves 19*a*, 19*b* are open, the solenoid valves 26*a*, 26*b* are closed, the solenoid valve 29 is closed after open for an activation preset time and the liquid pressure reducing mechanism 12 is full-open.

The high-temperature, high-pressure gas refrigerant discharged from the compressor 1 enters the heat source side heat exchanger 4 by way of the oil separator 2 and the four-way valve 3, and radiates heat to the outdoor air blown by the heat source side fan 5. This refrigerant, after outflowing from the heat source side heat exchanger 4, flows through the high pressure pipes 8 and the gas-liquid separator 9 by way of the check valve 7*a*, flows through the pipe 10, and is cooled by a low-pressure refrigerant at the supercooling heat exchanger 11. The refrigerant, after outflowing from the supercooling heat exchanger 11, passes through the liquid pressure reducing mechanism 12 which is full-open, and is further cooled by the low-pressure refrigerant at the supercooling heat exchanger 13. Thereafter, the refrigerant is distributed to the refrigerant flowing to the check valves 14*a*, 14*b* and the bypass pressure reducing mechanism 22.

The refrigerant having flowed to the check valves 14*a*, 14*b*, passes the indoor liquid branch pipes 15*a*, 15*b*, is decompressed at the use side pressure reducing mechanisms 16*a*, 16*b*, and becomes a low-pressure two-phase refrigerant. This low-pressure two-phase refrigerant flows into the use side heat exchangers 17*a*, 17*b*, cools the indoor air, and becomes a low-pressure gas refrigerant. This low-pressure gas refrigerant, after outflowing from the use side heat exchangers 17*a*, 17*b*, passes the solenoid valves 19*a*, 19*b* by way of the indoor gas branch pipes 18*a*, 18*b*, and joins with refrigerant having flowed the bypass pressure reducing mechanism 22.

On the other hand, the refrigerant having entered the bypass pressure reducing mechanism 22 is decompressed thereby, becomes a low-pressure two-phase refrigerant, and then enters the low-pressure side supercooling heat exchanger 13 to be heated by a high pressure refrigerant. This refrigerant, after having outflowed from the supercooling heat exchanger 13, is further heated to a high pressure refrigerant at the low-pressure side of the supercooling heat exchanger 11. Thereafter, the refrigerant flows in the pipe 23, and joins with the refrigerant having flowed through the check valves 14*a*, 14*b*. The joined refrigerant, after flowing to the accumulator 21 by way of the low-pressure pipe 20, the check valve 7*b* and the four-way valve 3, is again suctioned by the compressor 1.

The use side pressure reducing mechanisms 16*a*, 16*b* are controlled at the control unit 104 so that the degrees of superheating at the use side heat exchangers 17*a*, 17*b* become predetermined values. The degrees of superheating at the use side heat exchangers 17*a*, 17*b* can be obtained by subtracting the detection temperatures at the temperature sensors 209*a*, 209*b* from the detection temperature at the temperature sensors 210*a*, 210*b*. The bypass pressure reducing mechanism 22 is controlled by the control unit 104 so that the degree of superheating at the low-pressure outlet of the supercooling heat exchanger 11 becomes a predetermined value. The degree of superheating at the low-pressure outlet of the supercooling heat exchanger 11 can be obtained by subtracting the detection temperature at the temperature sensor 214 from the detection temperature at the temperature sensor 213.

Further, the operation frequency of the compressor 1 is controlled by the control unit 104 so that the evaporating temperature becomes a predetermined value. The evaporating temperature is a saturation temperature of the refrigerant pressure detected at the pressure sensor 212. Furthermore, the rotation speed of the heat source side fan 5 is controlled by the control unit 104 so that the condensing temperature becomes a predetermined value. The condensing temperature is a saturation temperature of the refrigerant pressure detected at the pressure sensor 201.

(Normal Operation Mode: Heating Only Operation Mode)

In the heating only operation mode, the four-way valve 3 connects the discharge side of the compressor 1 to the junction point d, and connects the suction side of the compressor 1 to the gas side of the heat source side heat exchanger 4. The solenoid valves 19*a*, 19*b* are closed, the solenoid valves 26*a*, 26*b* are open, the solenoid valve 29 is closed after open for an activation preset time, and the liquid pressure reducing mechanism 12 is full-close.

The high-temperature, high-pressure gas refrigerant discharged from the compressor 1 flows to the gas-liquid separator 9 by way of the oil separator 2, the four-way valve 3, the check valve 7*c*, and the high pressure pipes 8. The refrigerant having entered the gas-liquid separator 9 then passes through the indoor gas branch pipes 18*a*, 18*b* by way of pipe 25, and solenoid valves 26*a*, 26*b*, and enters the use side heat exchangers 17*a*, 17*b*. The refrigerant having entered the use side heat exchangers 17*a*, 17*b* heats the indoor air and becomes a high pressure liquid refrigerant. This refrigerant, after outflowing from the use side heat exchangers 17*a*, 17*b*, is decompressed at the use side pressure reducing mechanisms 16*a*, 16*b* to become a two-phase refrigerant with a medium pressure.

This refrigerant flows through the indoor liquid branch pipes 15*a*, 15*b*, passes through the check valves 27*a*, 27*b*, flows in a high-pressure side of the supercooling heat exchanger 13, and is further decompressed at the bypass pressure reducing mechanism 22 to become a low-pressure two-phase refrigerant. This refrigerant flows in the low-pressure side of the supercooling heat exchanger 13 and the low-pressure side of the supercooling heat exchanger 11. Thereafter, the refrigerant enters the heat source side heat exchanger 4 by way of the pipe 23, the low-pressure pipe 20 and the check valve 7*d*. The refrigerant having frown into the heat source side heat exchanger 4, absorbs heat from the outdoor air blown by the heat source side fan 5 and becomes a low-pressure gas refrigerant. This refrigerant, after outflowing from the heat source side heat exchanger 4, passes through the accumulator 21 by way of the four-way valve 3, and is again suctioned by the compressor 1.

The use side pressure reducing mechanisms 16*a*, 16*b* are controlled by the control unit 104 so that the degrees of supercooling at the use side heat exchangers 17*a*, 17*b* become predetermined values. The degrees of supercooling at the use side heat exchangers 17*a*, 17*b* can be obtained by subtracting detection temperatures at the temperature sensors 209*a*, 209*b* from a saturation temperature that can be obtained by the detection pressure at the pressure sensor 206. Further, the bypass pressure reducing mechanism 22, is controlled by the control unit 104 such that the pressure difference of the liquid pressure reducing mechanism 12 becomes a predetermined value. The pressure difference of the liquid pressure reducing mechanism 12 can be obtained by subtracting a detection pressure at the pressure sensor 207 from the detection pressure at the pressure sensor 206.

Further, the operation frequency of the compressor 1 is controlled by the control unit 104 such that the condensing temperature becomes a predetermined value. Furthermore, the rotation speed of the heat source side fan 5 is controlled by the control unit 104 such that the evaporating temperature becomes a predetermined value.

(Normal Operation Mode: Cooling Main Operation Mode)

In the cooling main operation mode, the four-way valve 3 connects the discharge side of the compressor 1 to the gas side of the heat source side heat exchanger 4, and connects the suction side of the compressor 1 to the junction point d. Further, the solenoid valve 19*a* is open, the solenoid valve 19*b* is closed, the solenoid valve 26*a* is closed, the solenoid valve 26*b* is open, and the solenoid valve 29 is closed after open for an activation preset time.

The high-temperature, high-pressure gas refrigerant discharged from the compressor 1, enters the heat source side heat exchanger 4 by way of the oil separator 2 and the four-way valve 3, and radiates heat to the outdoor air blown by the heat source side fan 5. This refrigerant, after outflowing from the heat source side heat exchanger 4, flows in the high pressure pipe 8 by way of the check valve 7*a*, and enters the gas-liquid separator 9. The refrigerant having entered the gas-liquid separator 9 is distributed to the refrigerant flowing in the pipe 10 and the refrigerant flowing in the pipe 25 by the working of the gas-liquid separator 9. The refrigerant having flowed into the pipe 10 is cooled by the low-pressure refrigerant at the supercooling heat exchanger 11, is decompressed at the liquid pressure reducing mechanism 12, becomes a refrigerant with a medium pressure, and joins with the refrigerant having flowed in the pipe 25.

On the other hand, the refrigerant having flowed in the pipe 25, after passing through the solenoid valve 26*b* and the indoor gas branch pipe 18*b*, heats the indoor air at the use side heat exchanger 17*b* and becomes a high pressure liquid refrigerant. The refrigerant outflowed from the use side heat exchanger 17*b*, is thereafter decompressed at the use side pressure reducing mechanism 16*b* to become a refrigerant with a medium pressure, and then flows through the indoor liquid branch pipe 15*b*, the check valve 27*b*, and joins with the refrigerant having flowed in the pipe 10.

The joined refrigerant is, thereafter, cooled by the low-pressure refrigerant at the supercooling heat exchanger 13, and distributed to the refrigerant flowing into the check valve 14*a* and the bypass pressure reducing mechanism 22. The refrigerant having flowed to the check valve 14*a* passes the indoor liquid branch pipes 15*a*, is decompressed at the use side pressure reducing mechanism 16*a* to become a low-pressure two-phase refrigerant, cools the indoor air at the use side heat exchanger 17*a* and becomes a low-pressure gas refrigerant. This refrigerant, thereafter passes the solenoid valve 19*a* by way of indoor gas branch pipe 18*a*, and joins with a refrigerant having flowed through the bypass pressure reducing mechanism 22.

On the other hand, the refrigerant having entered the bypass pressure reducing mechanism 22 is decompressed at the bypass pressure reducing mechanism 22, becomes the low-pressure two-phase refrigerant, then enters the low-pressure side of the supercooling heat exchanger 13, and is heated by the high pressure refrigerant. This refrigerant is, thereafter, further heated at the low-pressure side of the supercooling heat exchanger 11 and becomes a high pressure refrigerant. This refrigerant thereafter joins with the refrigerant having flowed through the check valve 14*a*. The joined refrigerant, after having flowed into the accumulator 21 by way of the low-pressure pipe 20, the check valve 7*b* and the four-way valve 3, is again suctioned by the compressor 1.

The use side pressure reducing mechanism 16*a* is controlled by the control unit 104 so that the degree of superheating of the use side heat exchanger 17*a* becomes a predetermined value. The use side pressure reducing mechanism 16*b* is controlled by the control unit 104 such that the degree of supercooling at the use side heat exchanger 17*b* becomes a predetermined value. The liquid pressure reducing mechanism 12, is controlled by the control unit 104 such that the pressure difference of the liquid pressure reducing mechanism 12 becomes a predetermined value. The bypass pressure reducing mechanism 22 is controlled by the control unit 104 such that the degree of superheating at the low-pressure outlet of the supercooling heat exchanger 11 becomes a predetermined value.

Further, the operation frequency of the compressor 1 is controlled by the control unit 104 such that the evaporating temperature becomes a predetermined value. Furthermore, the rotation speed of the heat source side fan 5 is controlled by the control unit 104 such that the condensing temperature becomes a predetermined value.

(Normal Operation Mode: Heating Main Operation Mode)

In the heating main operation mode, the four-way valve 3 connects the discharge side of the compressor 1 to the junction point d, and connects the suction side of the compressor 1 to the gas side of the heat source side heat exchanger 4. The solenoid valve 19*a* is open, the solenoid valve 19*b* is closed, the solenoid valve 26*a* is closed, the solenoid valve 26*b* is open, the solenoid valve 29 is closed after open for an activation preset time, and the liquid pressure reducing mechanism 12 is at the full-close opening degree.

The high-temperature, high-pressure gas refrigerant discharged from the compressor 1 flows to the gas-liquid separator 9 by way of the oil separator 2, the four-way valve 3, the check valve 7*c*, and the high pressure pipe 8. The refrigerant having entered the gas-liquid separator 9, thereafter flows to the indoor gas branch pipe 18*b* by way of the pipe 25 and the solenoid valve 26*b*, and enters the use side heat exchanger 17*b*. The refrigerant having flowed into the use side heat exchanger 17*b* heats the indoor air and becomes a high pressure liquid refrigerant. The refrigerant, after having outflowed from the use side heat exchanger 17*b*, is decompressed at the use side pressure reducing mechanism 16*b* to become a two-phase refrigerant with a medium pressure.

This refrigerant flows into the indoor liquid branch pipe 15*b*, and flows in the high-pressure side of the supercooling heat exchanger 13 by way of the check valve 27*b*, and is distributed to the refrigerant flowing to the check valve 14*a* and the bypass pressure reducing mechanism 22. The refrigerant having flowed to the check valve 14*a* passes through the indoor liquid branch pipes 15*a*, is decompressed at the use side pressure reducing mechanism 16*a* to become a low-pressure two-phase refrigerant, cools the indoor air at the use side heat exchanger 17*a* and becomes a low-pressure gas refrigerant. This refrigerant thereafter passes through the solenoid valve 19*a* by way of the indoor gas branch pipe 18*a*, and joins with the refrigerant having flowed in the bypass pressure reducing mechanism 22.

On the other hand, the refrigerant having flowed into the bypass pressure reducing mechanism 22 is decompressed at the bypass pressure reducing mechanism 22, and becomes a low-pressure two-phase refrigerant. This refrigerant is thereafter heated by the high pressure refrigerant at the supercooling heat exchanger 13. This refrigerant thereafter flows in the low-pressure side of the supercooling heat exchanger 11, joins with the refrigerant having flowed through the check valve 14*a* by way of the pipe 25. The joined refrigerant absorbs heat from the outdoor air blown by the heat source side fan 5 at the heat source side heat exchanger 4 by way of the low-pressure pipe 20, the check valve 7*d* and becomes a low-pressure gas refrigerant. This refrigerant, thereafter, passes through the accumulator 21 by way of the four-way valve 3, and is again suctioned by the compressor 1.

The use side pressure reducing mechanism 16*a* is controlled by the control unit 104 such that the degree of superheating at the use side heat exchanger 17*a* becomes a predetermined value. The use side pressure reducing mechanism 16*b* is controlled by the control unit 104 such that the degree of supercooling at the use side heat exchanger 17*b* becomes a predetermined value. Further, the bypass pressure reducing mechanism 22 is controlled by the control unit 104 such that the pressure difference of the liquid pressure reducing mechanism 12 becomes a predetermined value.

Further, the operation frequency of the compressor 1 is controlled by the control unit 104 such that the condensing temperature becomes a predetermined value. Furthermore, the rotation speed of the heat source side fan 5 is controlled by the control unit 104 such that the evaporating temperature becomes a predetermined value.

<Performance of Trouble Diagnosis>

On a periodical inspection or at the time of the occurrence of the malfunction in the air-conditioning apparatus 100, a service person (worker) visits the installation place in which the unit is installed with the external controller 320 in which the controller control device 121 is installed and performs maintenance work. In the maintenance work, the worker searches for malfunction in the device. In this process, the air-conditioning apparatus 100 employs a method that will be described later in detail, and makes it possible to automatically ascertain the presence or absence of a trouble in the air-conditioning apparatus 100 and identify the trouble portion.

First, the service person inputs start of the trouble diagnosis operation mode to the input unit 122 of the controller control device 121. Then, in the diagnostic operation instruction unit 124 in the controller control device 121, it is determined to perform a particular operation mode, which is called a trouble diagnosis operation mode. The external communication unit 123 in the controller control device 121 transmits a determination instruction to the unit communication unit 105 of the unit control device 101. By the operation as the above, the air-conditioning apparatus 100 initiates the trouble diagnosis operation mode. In the trouble diagnosis operation mode, all the use units 303*a*, 303*b* are driven. The operation mode in this operation is, for example, cooling operation by all the indoor units, and operation is initiated so that the refrigerant flow becomes the same as the cooling only operation mode.

<Distinction of Trouble Mode>

Of course, a service person is at the installation place on performance of the trouble diagnosis operation, there is a demand that the trouble diagnosis operation is performed in as short time as possible to shorten the work time. The following describes the method for shortening the time needed for the trouble diagnosis operation.

In the air-conditioning apparatus 100, first, the items of diagnosis (diagnostic modes) are classified into two kinds depending on the method for trouble diagnosis of the component devices in the trouble diagnosis operation. In other words, a mode that, after changing the operation of the device, detects the trouble based on the presence or absence of the response of the sensor output value before and after the change is called a response detection diagnosis (response detection diagnosis mode), and a mode that detects a trouble based on the operational state including the refrigerant pressure or the temperature at a normal state is called a performance detection diagnosis (performance detection diagnosis mode) and they are distinguished from one another.

The trouble modes that are the targets of the response detection diagnosis targets include, specifically, for example, sensor drop-off, solenoid valve lock, LEV(pressure reducing mechanism) lock, compressor inverter defect, fan motor defect and a branching port setting error. In each of the diagnoses, a diagnosis target device is determined to be in a trouble by which or because of which the device has returned no response, in a case where a difference between a sensor output value of the device before the operation of the device and a sensor output value of the device after the start of the operation is within a predetermined range of value, or where the difference is equal to or smaller than a threshold value.

The trouble modes that are the targets of the performance detection diagnosis targets include, specifically, for example, pipe clogging, efficiency deterioration of the compressor 1, contamination of the heat source side heat exchanger 4 (heat exchanger contamination), refrigerant leakage (the insufficient amount of refrigerant).

After the initiation of the trouble diagnosis operation mode, liquid refrigerant moves from the accumulator 21 for a while. Therefore, it takes a time for the operational state to be stable (normal state). Since it is necessary that the operational state is stable during the performance detection diagnosis, executing the performance detection diagnosis during this period is difficult. On the other hand, in the response detection diagnosis, since the forcible change of operation is instructed to the devices and trouble diagnosis is performed before and after the instruction depending on the presence or absence of the sensor responses, it is possible to perform diagnosis even when the operational state is not stable. Therefore, response detection diagnosis precedes the trouble detection diagnosis.

Further, since in the performance detection diagnosis, the trouble is determined based on whether the operational state is appropriate, in other words, based on whether there is no performance decline (device deterioration), there is a possibility to result an erroneous determination unless it is confirmed in advance that control devices, such as, the LEV, the solenoid valve, the inverter, and the motor operate. Also from such a reason, it is necessary that execution of the response detection diagnosis precedes the performance detection diagnosis. Accordingly, in the air-conditioning apparatus 100, it is possible, by executing the trouble diagnosis operation described below, to perform the response detection diagnosis in an early stage.

In the response detection diagnosis, it is difficult to appropriately perform diagnosis where there are unintended fluctuation in the high-pressure-side pressure and the low-pressure-side pressure during the diagnosis. Therefore, the operation frequency of the compressor 1 is fixed during the trouble diagnosis operation. Further, the rotation speed Va[rpm] of the heat source side fan 5 is set to a fixed value according to the operation frequency F[Hz] of the compressor 1 and the outdoor air temperature Ta[degrees centigrade]. That is, a data table having the relationship of Va=f(F, Ta) is stored in the memory unit 125. The data table is prepared so that the condensing temperature is same as the target value in the cooling only operation mode, for example.

Figure 3:
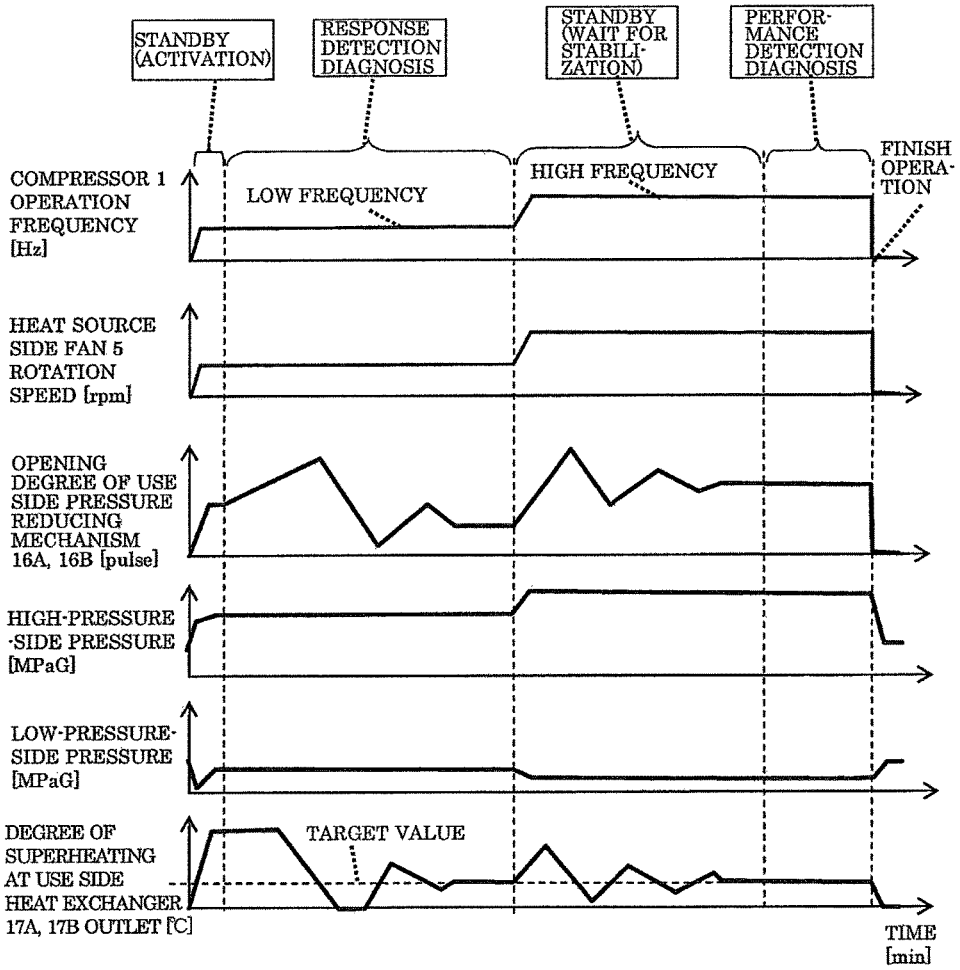
FIG. 3 is a time chart showing an operational state of a trouble diagnosis operation of an air-conditioning apparatus according to Embodiment 1 of the present invention.
Figure 4:
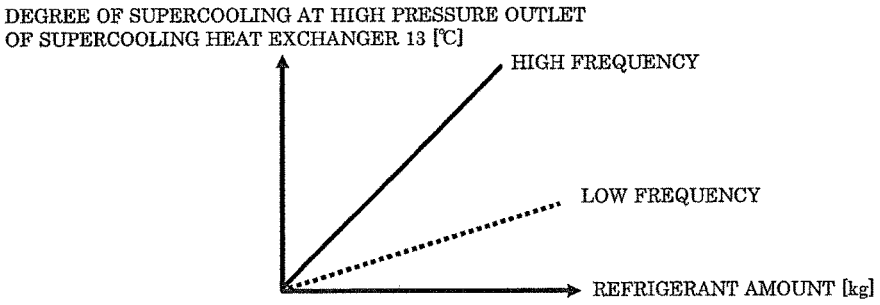
FIG. 4 is a schematic diagram showing a change degree of supercooling at a high-pressure side outlet of a supercooling heat exchanger against the amount of refrigerant.

FIG. 3 is a time chart showing the operational state of each actuator or other components of the air-conditioning apparatus 100 during the trouble diagnosis operation. FIG. 4 is a schematic diagram showing the change of the degree of supercooling at the high-pressure side outlet of the supercooling heat exchanger 13 against the amount of refrigerant. Based on FIG. 3 and FIG. 4, the timings in the operational state during the trouble diagnosis operation of the air-conditioning apparatus 100 will be described.

In the air-conditioning apparatus 100, the response detection diagnosis is executed after standing by for a predetermined time period (for example, 3 minutes) after operation activation. During the response detection diagnosis, the operation frequency of the compressor 1 and the rotation speed of the heat source side fan 5 is positively fixed. Since during the response detection diagnosis the device operation is forcibly changed, the operational state (for example, high-pressure-side pressure) extremely changes when the operation frequency of the compressor 1 is high, and there is a possibility that abnormal operation is caused. Therefore, the operation frequency of the compressor 1 is determined as the low frequency (for example 30 Hz). The air-conditioning apparatus 100 execute operation in this way. Therefore, it is possible to perform a response detection diagnosis even if the fluctuation of high-pressure-side pressure and low-pressure-side pressure is not controlled and the operational state does not become stable. Further, the device operation is forcibly changed to avoid abnormal operation.

The pressure reducing mechanism has an individual difference, and it is difficult to forecast how the operational state becomes when the opening degree is fixed. Therefore, control is performed based on the operational state in the same way as the normal operation mode (depending on the detection value of the operational state sensor). For example, the use side pressure reducing mechanisms 16*a*, 16*b* performs control such that, in the same way as the cooling only operation mode, the degrees of superheating at the outlets of the use side heat exchangers 17*a*, 17*b* become predetermined values (for example, target value 2 degrees centigrade). By controlling the opening degree of the pressure reducing mechanism according to the operational state in this way, it becomes possible to achieve an intended state of refrigerant distribution independent of the device. Also, other controls of the pressure reducing mechanisms, and solenoid valves are same as the cooling only operation mode since the refrigerant flow in the trouble diagnosis operation is set in the cooling only operation mode.

In the air-conditioning apparatus 100, after completion of the response detection diagnosis, the operation frequency of the compressor 1 is set to a high frequency, and the air-conditioning apparatus 100 stands by until the operational state is stabilized.

When the operational state is stabilized, the air-conditioning apparatus 100 then performs the performance detection diagnosis. In the performance detection diagnosis, it is possible to more accurately perform trouble determination when the operation frequency of the compressor 1 is set to a value of frequency set at the response detection diagnosis (for example, 60 Hz or greater). For example, with the refrigerant leakage diagnosis, as shown in FIG. 4, the degree of supercooling against the change in the amount of refrigerant becomes large as the operation frequency of the compressor 1 becomes high, and it is possible to determine the amount of the liquid refrigerant with high accuracy.

In addition, with pipe clogging, the pressure loss in the clogging part becomes large, and with the compressor efficiency deterioration, the compressor efficiency becomes high, and with heat exchanger contamination, the temperature difference between the air and refrigerant become large when the heat processed at the heat exchanger is high. In this way, in the performance detection diagnosis, the value of a parameter to determine presence or absence of a trouble becomes larger when the operation frequency of the compressor 1 is set to high capacity. Therefore, it is possible to determine trouble with high accuracy.

In order to shorten the diagnosis time, there is a demand that the time until the operational state becomes stable is shortened. Therefore, also in the performance detection diagnosis, the operation frequency of the compressor 1 and the rotation speed of the heat source side fan 5 are positively fixed. Since the operation frequency of the compressor 1 becomes high, the rotation speed of the heat source side fan 5 on performing the detection diagnosis is fixed at a rotation speed higher than in the response detection diagnosis. With the above configuration, the fluctuation of high-pressure-side pressure and low-pressure-side pressure are suppressed. Therefore, it becomes easy to control the opening degree of the pressure reducing mechanism to a target operational state. As a result, the operational state is stabilized in an early stage. After completion of the performance detection diagnosis, trouble diagnosis operation is completed.

Figure 5:
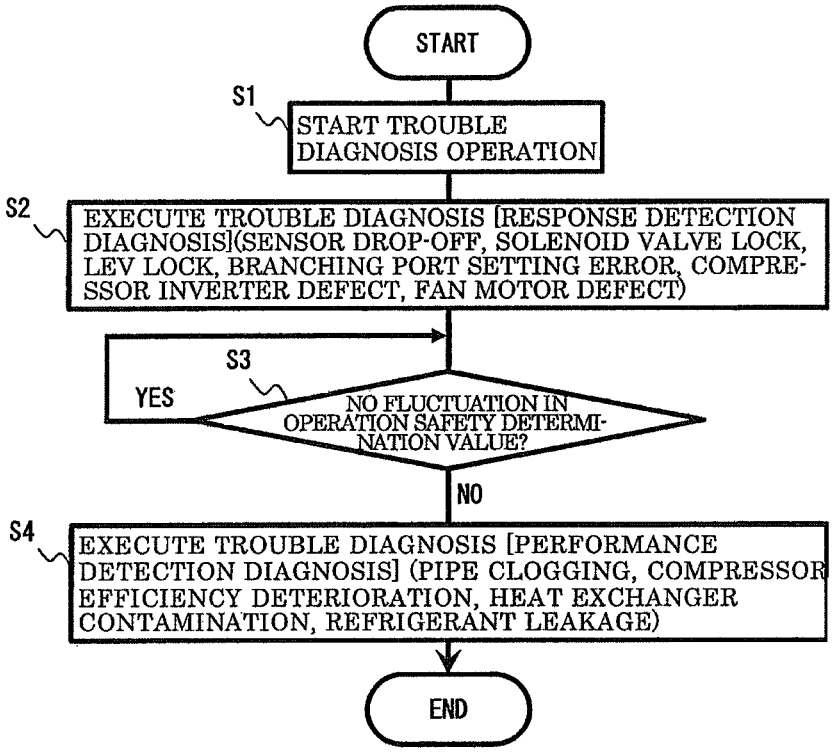
FIG. 5 is a flowchart showing an order in the diagnosis at a trouble diagnosis operation of the air-conditioning apparatus according to Embodiment 1 of the present invention.

FIG. 5 is a flowchart showing the relations of order of diagnoses in the trouble diagnosis operation of the air-conditioning apparatus 100. By using FIG. 5, the flow of process in the operation of the air-conditioning apparatus 100 in the trouble diagnosis operation will be described.

When the air-conditioning apparatus 100 initiates the trouble diagnosis operation (step S1), the sensor value appropriateness determination detection, in other words, a trouble diagnosis based on the response detection diagnosis is performed in step S2. Thereafter the air-conditioning apparatus 100 stands by until there is no fluctuation in the operation safety determination value (stability determination index) for determining that the operational state is stable in step S3. Where the operation safety determination value has become constant, trouble diagnosis based on the operational state appropriateness detection, in other words, performance detection diagnosis is performed in step S4, and thereafter, the trouble diagnosis operation is terminated.

The stability of the operational state before performance of the detection diagnosis in step S3 is determined based on the presence or absence of fluctuation of the operation safety determination value. Where there is no longer movement of the liquid refrigerant from accumulator 21, the fluctuation of the operational state arises no more. Therefore, a value by which it is understood that the refrigerant has moved to the high-pressure side from the accumulator 21 is selected as a determination value.

By the movement of the refrigerant to the high-pressure side, the humidity of the refrigerant state at the inlets of the use side pressure reducing mechanisms 16*a*, 16*b* increases and the degrees of superheating at the outlets of the use side heat exchangers 17*a*, 17*b* become small, and by the control of the control unit 104, the opening degrees of the use side pressure reducing mechanisms 16*a*, 16*b* decrease. Further, when the refrigerant moves to the high-pressure side, the degree of supercooling at the high-pressure side outlet of the supercooling heat exchanger 13 increases. Therefore, the opening degrees of the use side pressure reducing mechanisms 16*a*, 16*b* and the degree of supercooling at the high-pressure side outlet of the supercooling heat exchanger 13 is used as a stability determination value. For example, it is possible to detect the stability of the operational state by having a predetermined criterion. The criterion may be whether, during a predetermined period (for example, 5 minutes), a change of the opening degrees of all the use side pressure reducing mechanisms 16*a*, 16*b* is 5% or less, and a change in the degree of supercooling at the high-pressure side outlet of supercooling heat exchanger 13 is within the range of 1 degrees centigrade.

Where, for example, only the degree of supercooling is used as the stability determination value, it becomes not possible to observe the change in the operational state where the degree of supercooling is continuously zero as in the case that the amount of refrigerant is insufficient, and there is a possibility that the apparatus may erroneously determine that the operational state is stabilized when the change in the state is small although the device is operating. Further, if only the pressure reducing mechanism opening degree is used as the stability determination value, it takes a time for response of the degree of supercooling against the device operation. Therefore, there is a possibility to erroneously determine that the operational state is stabilized although the operational states, such as the degree of supercooling, are changing. Then, by determining the stability by two indexes of the operational state and the device operation, it is possible to determine the stability of the operational state with high accuracy.

The degree of supercooling against the stability determination value is not limited to the degree of supercooling at the high-pressure side outlet of the supercooling heat exchanger 13. The degree of supercooling at any positions in the range from the discharge side of the compressor 1 to the use side pressure reducing mechanisms 16*a*, 16*b*. Further, the pressure reducing mechanism may be any pressure reducing mechanism as long as it is controlled by the control unit 104 such that the operational state becomes a predetermined value, and the opening degree of the bypass pressure reducing mechanism 22 may be used as the stability determination value. This is because, by the movement of the refrigerant to the high-pressure side, the refrigerant state at the inlet of the bypass pressure reducing mechanism 22 gets wet.

<Trouble Mode and Method for Diagnosis Thereof>

Here, the trouble content and the method for diagnosis therefor will be described specifically. First, the items of diagnosis of the response detection diagnosis will be described. As described above, the trouble mode that is the target of the response detection diagnosis includes sensor drop-off, solenoid valve lock, LEV lock, compressor inverter defect, fan motor defect, and branching port setting error.

The sensor drop-off refers to, for example, a trouble in which the temperature sensor installed (adhered) for refrigerant temperature detection in the pipe unit comes apart therefore. Where there is a sensor drop-off in the temperature sensor 202 detecting the discharge temperature, there is a possibility that detection of the rise in temperature at the discharge side might fail and the compressor 1 might be damaged. A method for detecting the sensor drop-off is the following: it is determined that the sensor drop-off is occurring where the air temperature around the position where each unit is installed and the sensor measurement value of the temperature sensor is predetermined value or less (for example, 3 degrees centigrade or less) after activation of the compressor 1. In the case of the heat source unit 301, since the temperature of ambient air is the outdoor air temperature, the detection temperature of the temperature sensor 204 is used as the temperature of the ambient air. In the case of the use units 303*a*, 303*b*, since the temperature of ambient air is the indoor air temperature, the detection temperature of the temperature sensors 211*a*, 211*b* are used as the temperature of the ambient air. In the case of the relay unit 302, since it is ordinarily installed indoors, an average of the detection temperatures of the use units 303*a*, 303*b* are employed as the temperature of ambient air.

The solenoid valve lock refers to a trouble in which the solenoid valve locks to be immovable from the open or close state. For example, when the solenoid valve 29 is opening-locked, the state of refrigerant is turned into a state where it bypasses to low-pressure. Therefore, cooling or heating capacities of the use side heat exchangers 17*a*, 17*b* are in short. A method for detecting the solenoid valve lock is the following: the solenoid valve is forcibly changed to an open or a close state, and a difference between the detection value of the pressure sensor before the change in the solenoid valve state and the detection value after the change in the solenoid valve state are compared and it is checked if the difference is within a predetermined range of value. Or, a difference between the detection value of the temperature sensor before the change in the solenoid valve state and the detection value of the temperature sensor after the change in the solenoid valve state are compared and it is checked if the difference is within a predetermined range of value. When the solenoid valve 29 is instructed to forcibly open during the operation of the air-conditioning apparatus 100, if high-pressure-side pressure decreases (for example, by more than 0.2 MPa) and low-pressure-side pressure rises (for example, by more than 0.1 MPa), it is determined that the solenoid valve is not locked. Here, high-pressure-side pressure refers to a detection pressure of the pressure sensor 201, while low-pressure-side pressure refers to a detection pressure of the pressure sensor 212.

LEV lock refers to a trouble in which LEV (pressure reducing mechanism) locks and becomes unmovable where the opening degree is instructed. For example, when the use side pressure reducing mechanisms 16*a*, 16*b* are locked, it becomes not possible to flow the refrigerant to the use side heat exchangers 17*a*, 17*b* to achieve a predetermined refrigerant flow rate, and cooling or heating capabilities of the use side heat exchangers 17*a*, 17*b* are excessive or in short. A method for detecting the LEV lock is the following: the LEV opening degree is forcibly changed to a predetermined opening degree. Then, and a difference between the detection value of the pressure sensor before the change in the LEV opening degree and the detection value of the pressure sensor after the change in the LEV opening degree are compared and it is checked if the difference is within a predetermined range of value. Or, a difference between the detection value of the temperature sensor before the change in the LEV opening degree and the detection value of the temperature sensor after the change in the LEV opening degree are compared and checked if the difference is within a predetermined range of value. For example, it is determined that the LEV lock is not caused in the case where the detection temperatures of the temperature sensors 210*a*, 210*b* increase, for example by more than 3 degrees centigrade when the use side pressure reducing mechanisms 16*a*, 16*b* are instructed to have the opening degrees of full-close, or in the case where the detection temperatures of the temperature sensors 210*a*, 210*b* decrease, for example by more than 3 degrees centigrade when the use side pressure reducing mechanisms 16*a*, 16*b* are instructed to have the opening degrees of full-open.

It is possible, also for other solenoid valves or LEVs (pressure reducing mechanisms) than described above, to determine the trouble of the solenoid valve lock and the LEV lock in the same way by comparing the sensor values before and after the change of the operation.

A compressor inverter defect refers to a trouble of a compressor invertor 35 in which it becomes not possible to change the operation frequency of the compressor 1. A method for detecting the compressor inverter defect is the following: the compressor 1 is instructed to forcibly operate in an increased operation frequency/speed, and it is determined that the compressor inverter defect is occurring when the high-pressure-side pressure after the change in the operation frequency/speed does not increase by more than, for example, 0.2 MPa as compared to that before the change. Here, high-pressure-side pressure refers to the detection pressure of the pressure sensor 201.

The fan motor defect refers to a trouble of fan motor 6 in which it becomes not possible to change the rotation speed of the heat source side fan 5. A method for detecting the fan motor defect is the following: the heat source side fan 5 is instructed to forcibly operate in a decreased rotation speed, and it is determined that the compressor inverter defect is occurring when high-pressure-side pressure does not increase by more than, for example, 0.2 MPa after the change in the rotation speed as compared to that before the change.

Figure 6:
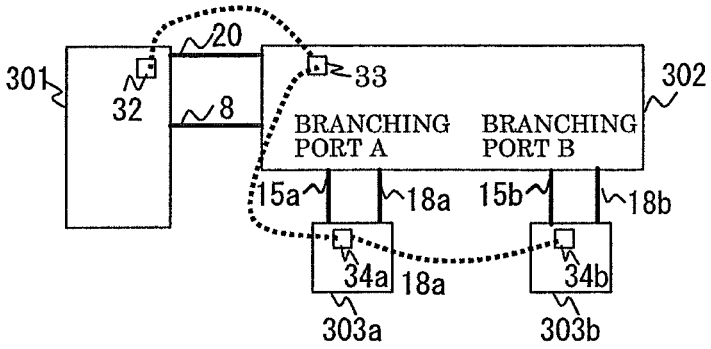
FIG. 6 is a schematic diagram showing a state of wiring a transmission line of an air-conditioning apparatus according to Embodiment 1 of the present invention.

FIG. 6 is a schematic diagram showing the wiring state of the transmission line of the air-conditioning apparatus 100. Based on FIG. 6, branching port setting error will be described. In a normal case where, for example, the transmission line between the units are connected by a transition wiring (dashed lines shown in FIG. 6), the connection of the refrigerant pipes and the electrical connection are independent from one another regarding the connection of the use units 303*a*, 303*b* at the respective branching ports of the relay unit 302. Therefore, a setting separate from the electrical connection is necessary regarding which one of the branching ports each of the use units 303*a*, 303*b* is to be connected to.

For example, when it is determined to set the connection of the branching ports at the use unit, by setting the use unit 303*a* to be connected to the branching port A, the solenoid valve 19*a* is open, and the solenoid valve 26*a* is closed where the use unit 303*a* is turned into the cooling operation, and it is possible to perform cooling normally. However, where the use unit 303*a* is set as being connected to the branching port B although it is actually connected to the indoor liquid branch pipes 15*a* and the indoor gas branch pipe 18*a* (branching port setting error), it becomes not possible to normally perform cooling since the solenoid valve 19*b* opens and the solenoid valve 26*b* is closed, and the solenoid valve 19*a* stays closed where the use unit 303*a* is turned into the cooling operation.

The method of detection of the branching port setting error is as follows. In the use unit 303*a*, where the solenoid valve 19*a* and the solenoid valve 26*a* are in the cooling flow pass (solenoid valve 19*a* is open and the solenoid valve 26*a* is closed), a low-pressure low-temperature refrigerant flows to the use unit 303*a*. Therefore, the liquid temperature on the use side becomes lower than the indoor air temperature. Here, the use side liquid temperature is the detection temperature of the temperature sensor 209*a*, and the indoor air temperature is the detection temperature of the temperature sensor 211*a*. On the other hand, where the solenoid valve 19*a*, and the solenoid valve 26*a* are in the heating flow pass (solenoid valve 19*a* is closed, and the solenoid valve 26*a* is open), the high-temperature, high-pressure refrigerant flows to the use unit 303*a*, the use side liquid temperature becomes higher than the indoor air temperature. The difference is utilized for detection. In other words, it is determined that the branching port setting error is not occurring where the use side liquid temperature has reached a threshold or become higher than a threshold when the solenoid valve of the branching port set in the use unit 303*a* is switched from the cooling flow pass to the heating flow pass. The threshold may be, for example, the indoor air temperature.

Next, the items of diagnosis for the performance detection diagnosis will be described. As described above, trouble modes that are targets of the performance detection diagnosis include pipe clogging, efficiency deterioration of the compressor 1, contamination of the heat source side heat exchanger 4 (heat exchanger contamination) and refrigerant leakage (the insufficient amount of refrigerant).

Pipe clogging refers to a trouble in which solid impurity causes clogging within the pipes to prevent the refrigerant flow. For example, where clogging is caused in the pipes of the low-pressure pipe 20, pressure loss in the low-pressure pipe 20 increases, the cooling or heating capabilities of the use side heat exchangers 17*a*, 17*b* are markedly reduced. A method for detecting pipe clogging is the following: a pressure loss computation value (ΔPcalc) is obtained from the specs of the low-pressure pipe 20, and it is compared with the pressure loss observed value (ΔPreal).

The pressure loss computation value ΔPcalc[Pa] can be obtained by the following formula 1:

$$\Delta Pcalc=\lambda\times(L/D)\times Gr\hat{}2/(2\times pPGm\times A\hat{}2) \quad \text{(formula 1)}$$

Here, λ is a friction factor "–", and can be calculated based on conventionally proposed empirical formulae. Further, A denotes the cross-sectional area of the low-pressure pipe 20 [m^2], D denotes internal diameter of a pipe[m], and L denotes the length of a pipe [m]. The diameter and the thickness of the low-pressure pipe 20 connected to the heat source unit 301 is predetermined, and the internal diameter of the pipe D and the cross-sectional area A of the pipe can be obtained therefrom. Further, the pipe length L[m] is the pipe length input by the worker in advance, or selected from "long", "average", and "short". For example, where the specific value of the pipe length is unknown, the lengths that can be estimated from on-site installation circumstance are entered by storing in advance the reference lengths (for example, 100 m for "long", 60 m for "ordinarily", and 30 m for "short", etc.).

Gr denotes the refrigerant flow rate [kg/s] in the low-pressure pipe 20, which can be obtained as being the same as the discharge flow rate of the compressor 1, based on high-pressure-side pressure, low-pressure-side pressure and the operation frequency of the compressor 1. ρPGm denotes refrigerant density of the low-pressure pipe 20 [g/m^3], which is the average of the degree of density of the refrigerant saturation gas computed from the detection pressure of the pressure sensor 212 and the degree of density of the refrigerant saturation gas computed where the detection temperature of the temperature sensor 213 is used as the saturation temperature. The pressure loss observed value ΔPreal[Pa] is obtained by subtracting the detection pressure of the pressure sensor 212 from the pressure computed where the detection temperature of the temperature sensor 213 is used as the saturation temperature.

As described above, both pressure losses are obtained, and where the pressure loss observed value ΔPreal is larger by a predetermined value than a pressure loss computation value ΔPcalc, it is detected that there is pipe clogging in the low-pressure pipe 20.

The efficiency deterioration of the compressor 1 refers to a trouble in which the compressor efficiency (here, the adiabatic efficiency) declines and the compressor input [kW] increases due to the deterioration of the compressor 1. The method for detecting the efficiency deterioration of the compressor 1 is the following. The method detects there is an efficiency deterioration of the compressor 1 where the adiabatic efficiency (adiabatic efficiency of the practically applied apparatus) obtained from the present operational state is lower than the adiabatic efficiency (adiabatic efficiency of the apparatus at the developmental stage) obtained from the data on the development by a predetermined proportion (%). The adiabatic efficiency of the apparatus at the developmental stage is computed from high-pressure-side pressure, low-pressure-side pressure, operation frequency of the compressor 1 at the present trouble detection operation by referring to a data table of the adiabatic efficiency of the apparatus at the developmental stage that includes high-pressure-side pressure, low-pressure-side pressure, and the operation frequency of the compressor 1 and that is prepared based on the test data or simulation on the development.

High-pressure-side pressure is a detection pressure of the pressure sensor 201, and low-pressure-side pressure is the detection pressure of the pressure sensor 212. Practically applied adiabatic efficiency ηc_real is obtained by following formula (2).

$$\Delta\eta c_real=(hdad-hs)/(hd-hs) \quad \text{(formula 2)}$$

Here, hdad denotes discharge specific enthalpy at isentropic compression of the compressor 1 [kJ/kg], and is obtained from low-pressure-side pressure, high-pressure-side pressure and the suction temperature. The suction temperature is the detection temperature of the temperature sensor 214. The sign hs denotes the suction specific enthalpy of the compressor 1, and is obtained from low-pressure-side pressure and the suction temperature. The sign hd is the discharge specific enthalpy of the compressor 1, and is obtained from high-pressure-side pressure and the discharge temperature. The discharge temperature is the detection temperature of the temperature sensor 202.

Where there is heat exchanger contamination, the performance of the heat source side heat exchanger 4 declines, and where the heat source side heat exchanger 4 serves as a condenser at the cooling only operation mode, high-pressure-side pressure increases, and where the heat source side heat exchanger 4 serves as an evaporator at the heating only operation mode, the low-pressure-side pressure declines, and the input to the compressor 1 increases. As a result, the operation performance reduces. A method for detecting the heat exchanger contamination is the following: where high-pressure-side pressure is a predetermined value or greater during the trouble diagnosis operation, it is determined that the performance of the heat source side heat exchanger 4 is markedly declined and there is contamination. Where any object is placed near the installation location of the heat source side heat exchanger 4, air course pressure loss increases and the gas volume is reduced. It is also possible to detect this case with the same method as that for the heat exchanger contamination.

Where the amount of refrigerant of the air-conditioning apparatus 100 is insufficient by refrigerant leakage, high-pressure-side pressure and low-pressure-side pressure are declined, and the cooling capacities of the use unit 303*a*, 303*b* become insufficient. The method for detecting refrigerant leakage is, for example, the following: where the degree of supercooling at the high-pressure side outlet of the supercooling heat exchanger 13 is 2 degrees centigrade or less based on the operational state on the trouble diagnosis, it is detected there is a refrigerant leakage. The degree of supercooling at the high-pressure side outlet of the supercooling heat exchanger 13 is obtained by subtracting the temperature of the temperature sensor 208 from the saturation temperature of the detection pressure of the pressure sensor 207.

The diagnosis procedure of the trouble diagnosis as described above and parameters necessary for the diagnosis are stored in the memory unit 125 of the controller control device 121. The computation necessary for diagnosis is computed by the diagnosis computation unit 126, and presence or absence of the trouble is determined by the determination unit 127 based on the result of computation. The result of determination is displayed on the display unit 128. Since the result of determination is displayed on the display unit 128, it becomes possible for the worker to easily determine the trouble portions.

<Specification of Diagnosis Portions>

Here, with the search for trouble parts at the occurrence of abnormality, it is possible to some extent forecast the trouble portion depending on the abnormality content. By causing the device to execute diagnosis operation depending on the abnormality content by limiting the trouble item of diagnosis, it is possible to find trouble portions at an early stage. For example, where high-pressure-side pressure abnormality rise is caused, possible trouble portions may include heat exchanger contamination, solenoid valve lock of the solenoid valve 29, motor defect of fan motor 6, and where only a part of chambers are non-cooling (cold air is not blown from the use unit 303*a*), LEV lock of the use side pressure reducing mechanism 16*a*, and branching port setting error of the use unit 303*a* may be possible, and the diagnosis is limited to these items.

<Refrigerant Flow at Diagnosis Operation>

In the present Embodiment 1, the refrigerant flow in the trouble diagnosis operation is based on that in the cooling only operation mode. However, the refrigerant flow of the present invention is not confined within the configuration, and the refrigerant flow in the trouble diagnosis operation may be based on the heating only operation mode. In the case where the outdoor air temperature is particularly low, it becomes difficult to perform cooling only operation mode. Therefore, control of each device is performed based on the refrigerant flow in the heating only operation mode.

As described above, in the air-conditioning apparatus 100, it becomes possible to perform identification of trouble portion in the trouble diagnosis operation. In the air-conditioning apparatus 100, by positively fixing the operation frequency of the compressor 1 and the rotation speed of the heat source side fan 5 with a response detection diagnosis and a performance detection diagnosis, and performing the trouble diagnosis operation, it is possible to automatically identify malfunctioning portion with high accuracy and in a short time where trouble portions are unidentified, and display the malfunctioning portion. Therefore, it is possible to appropriately find and fix the malfunctioning part regardless of the experience or the ability a worker, and the work time is shortened. Therefore, service organization is more improved.

Embodiment 2

Embodiment 2 describes principally the point of difference from Embodiment 1, and explanations are omitted for those portions which are same as Embodiment 1. The configuration of the air-conditioning apparatus according to Embodiment 2 is the same as the configuration of the air-conditioning apparatus 100 according to Embodiment 1. The portions different from Embodiment 1 are that it executes trouble diagnosis operation in order to determine whether the construction state is appropriate after the installation work of the air-conditioning apparatus.

In the installation work, the worker connects the heat source unit 301 and the relay unit 302 with a high pressure pipe 8 and a low-pressure pipe 20 on the installation place, and connects the relay unit 302 and the use units 303*a*, 303*b* with the indoor liquid branch pipes 15*a*, 15*b* and the indoor gas branch pipes 18*a*, 18*b*. Thereafter, the branching port to which the indoor liquid branch pipes 15*a*, 15*b* and the indoor gas branch pipes 18*a*, 18*b* are connected are set in the use unit 303*a*, 303*b*, and the refrigerant is loaded. The principal parts of the installation work are as described above.

Since the installation work is implemented manually, there is a high possibility that mistakes may take place. If there occurs an installation error, the worker needs to confirm the state later by visiting the installation place, which leads to the increase in the service time. Therefore in Embodiment 2, by employing a trouble diagnosis operation to determine whether the construction is appropriately completed, the number of mistakes in the construction is reduced as close to zero as possible, and the increase in service time due to the mistakes in construction work is suppressed. Possible mistakes that may frequently occur in the installation work include the following two: mistakes in loading refrigerant (insufficient loading amount) and mistakes in branching port setting. The worker visits the construction site with the external controller 320, and executes the two diagnoses by the trouble diagnosis operation after completion of the installation work.

<Confirmation of Appropriate Completion of Installation Work>

Figure 7:
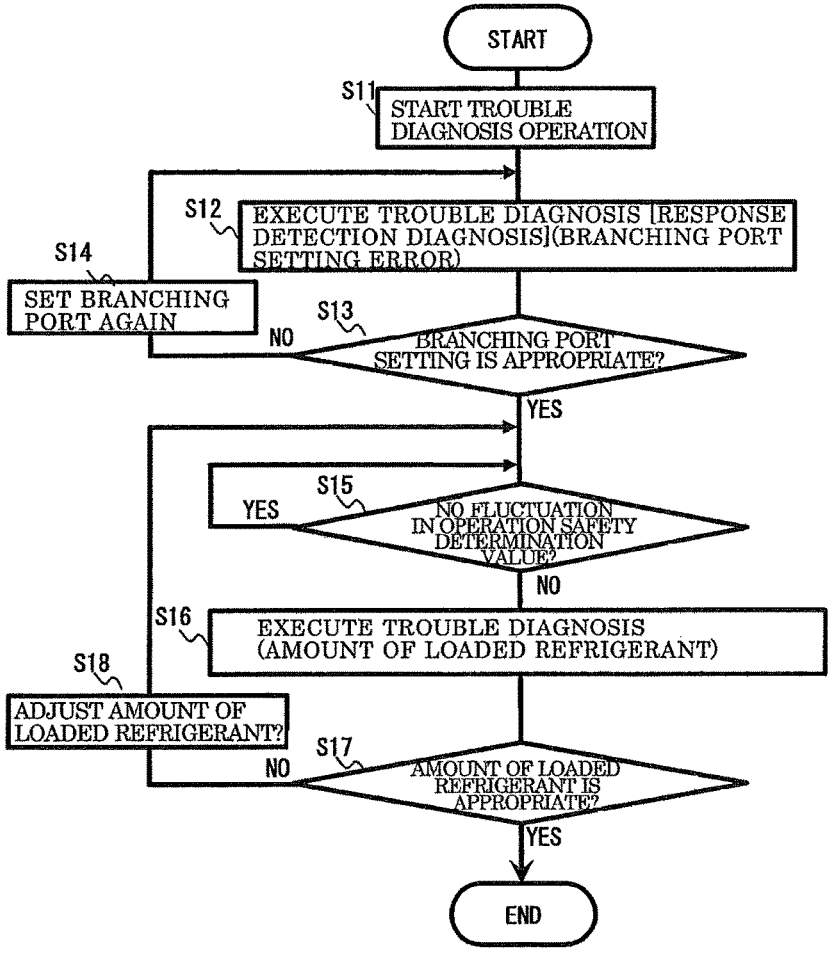
FIG. 7 is a flowchart showing a flow on a process of confirming appropriate completion of an installation work by using a trouble diagnosis operation after the installation work of the air-conditioning apparatus according to Embodiment 2 of the present invention.

FIG. 7 is a flowchart showing the flow of the process on the confirmation of appropriate completion of the installation work of the air-conditioning apparatus according to Embodiment 2 by using the trouble diagnosis operation after completion of the installation work. Referring to FIG. 7, explanations will be given of trouble diagnosis operation for determining whether the construction state is appropriate after installation work of the air-conditioning apparatus according to Embodiment 2.

When the air-conditioning apparatus according to Embodiment 2 initiates the trouble diagnosis operation (step S11), the air-conditioning apparatus performs in step S12 a sensor value appropriateness determination detection, that is, trouble diagnosis by using the response detection diagnosis (for example, branching port setting error). The method for diagnosis of the branching port setting error is similar to Embodiment 1. Thereafter, where it is diagnosed in step S13 that the branching port setting is not appropriate, the worker confirms in step S14 the branching port setting of the use units 303*a*, 303*b*, and again performs setting so that the setting are appropriate.

Then, the air-conditioning apparatus according to Embodiment 2, again performs diagnosis in step S12, and confirms in step S13 whether the branching port setting is appropriate. Thereafter, where it is determined in step S15 that there is no fluctuation in the operation safety determination value, trouble diagnosis (refrigerant loading amount) by operational state appropriateness detection, that is, the performance detection diagnosis, is performed in step S16. The method for diagnosing the refrigerant loading amount is as follows. Where, for example, the degree of supercooling at the high-pressure side outlet of the supercooling heat exchanger 13 is 2 degrees centigrade or under based on the operational state of the trouble diagnosis, it is determined that the refrigerant loading amount is insufficient. Or, where the degree of supercooling at the high-pressure side outlet of the supercooling heat exchanger 13 is 20 degrees centigrade or higher, it is detected as excessive loading of the refrigerant.

Then, where it is determined in step S17 that the refrigerant loading amount is not appropriate, or where the amount of refrigerant is determined to be insufficient or excessive, the worker supplements refrigerant in step S18, or adjusts the refrigerant loading amount by withdrawing the refrigerant. Thereafter, in the air-conditioning apparatus according to Embodiment 2, since the refrigerant loading amount has been adjusted, it is confirmed in step S16 that there is no fluctuation in the operation safety determination value, and the diagnosis is again performed in step S15. The flow of step S18, step S15 and step S16 are repeated until it is determined that the refrigerant loading amount is appropriate in step S17. Where it is determined in step S17 that the refrigerant loading amount is appropriate, the trouble diagnosis operation is terminated.

Figure 8:
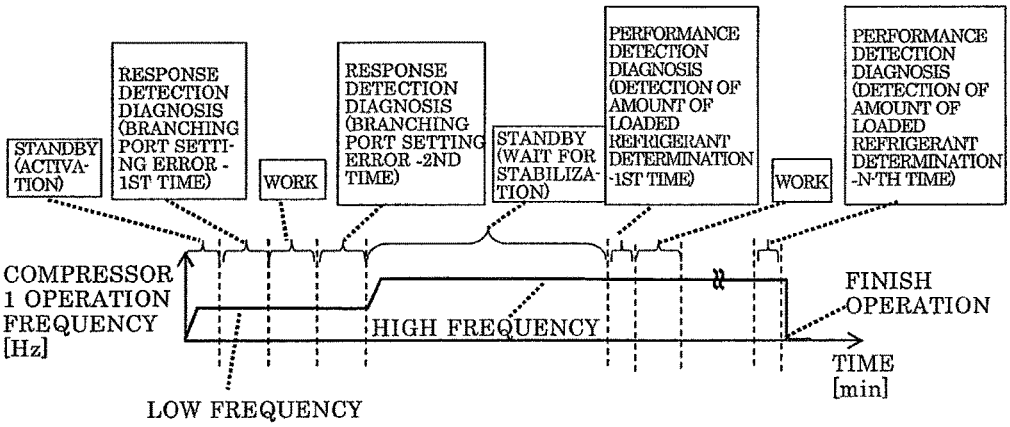
FIG. 8 is a time chart showing a state of an operation frequency of a compressor of an air-conditioning apparatus according to Embodiment 2 of the present invention during a trouble diagnosis operation.

FIG. 8 is a time chart showing the change in the state of the operation frequency of the compressor 1 of the air-conditioning apparatus according to Embodiment 2 during the trouble diagnosis operation. Based on FIG. 8, timing in the state of the operation frequency of the compressor 1 of the air-conditioning apparatus according to Embodiment 2 during the trouble diagnosis operation will be described.

In the air-conditioning apparatus according to Embodiment 2, trouble diagnosis of the same items are repeated with the operation frequency of the compressor 1 being positively fixed until both states of the branching port setting and the refrigerant loading amount become appropriate. In this case, in Embodiment 2, the diagnosis is continuously repeated until the construction becomes appropriate (until the trouble determine becomes absent), to thereby reduce the time for diagnosis again performed after the mistakes in the construction is reduced. That is, when the unit is stopped and started up again, it takes time to perform diagnosis since there is standby time at activation. However, Embodiment 2 can avoid such a situation. Further, in Embodiment 2, since it is displayed that the construction is appropriately performed, it is possible to reliably confirm that the construction is appropriately performed.

Accordingly, the air-conditioning apparatus according to Embodiment 2 not only achieve the same effect as the air-conditioning apparatus 100 according to Embodiment 1, but also makes it possible to reduce the mistakes in construction work as close to zero as possible by using the trouble diagnosis operation for determining the appropriate completion of the construction, it is possible to make the construction mistakes as close to zero as possible, and it is possible to control the increase of service time due to construction mistakes.

It is possible to repeatedly perform diagnosis similarly for those devices that can be repaired while the compressor 1 is driven, also in the trouble diagnosis on the periodical inspection or the diagnosis of malfunction at the occurrence of the malfunction, independent of the appropriateness diagnosis after construction. This reduces the work time.

Embodiment 3

Figure 9:
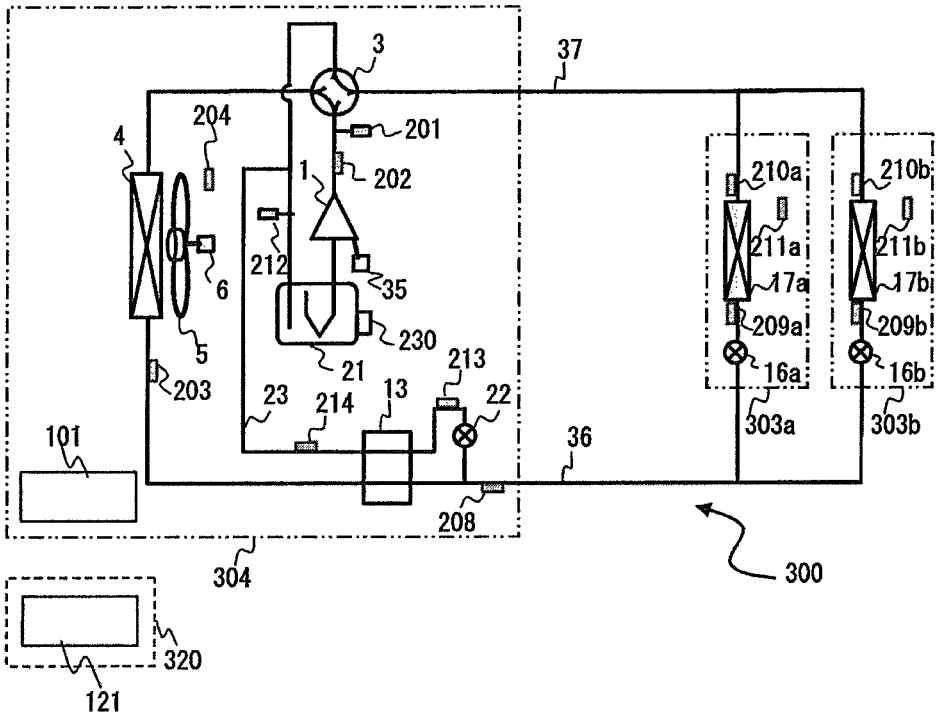
FIG. 9 is a schematic diagram showing a refrigerant circuit configuration of an air-conditioning apparatus according to Embodiment 3 of the present invention.

FIG. 9 is a schematic diagram showing the refrigerant circuit configuration of the air-conditioning apparatus 300 according to Embodiment 3 of the present invention. Based on FIG. 9, the configuration of the air-conditioning apparatus 300 will be described. Embodiment 3 principally describes the point of difference from Embodiment 1 described above, and the explanations for the portions of the same working are omitted with the same signs being adhered.

The air-conditioning apparatus 300 is different from the air-conditioning apparatus 100 according to Embodiment 1 in that it does not comprises the relay unit. More specifically, the air-conditioning apparatus 300 is configured so that the second heat source unit 304 and the use unit 303*a*, 303*b* are connected to the indoor liquid pipe 36 and the indoor gas pipe 37 that are refrigerant pipes. The air-conditioning apparatus 300 can process the cooling instruction (cooling ON/OFF) or heating instruction (heating ON/OFF) selected in the use units 303*a*, 303*b*, and it is possible to perform cooling or heating.

<Second Heat Source Unit 304>

The second heat source unit 304 is installed, for example, outdoors, and supplies refrigerant to the use units 303*a*, 303*b* according to the operation requested in the use units 303*a*, 303*b*. The second heat source unit 304 includes a compressor 1, a compressor invertor 35, a four-way valve 3, a heat source side heat exchanger 4, a heat source side fan 5, a fan motor 6, a supercooling heat exchanger 13, an accumulator 21, a bypass pressure reducing mechanism 22 and a pipe 23. The function of each device is the same as each device provided for the air-conditioning apparatus 100 according to Embodiment 1.

In the second heat source unit 304, a pressure sensor 201 is provided in the discharge side of the compressor 1, and the pressure sensor 212 is provided in the upstream of the accumulator 21. These sensors measure the refrigerant pressure at the installation location.

Further, in the second heat source unit 304, a temperature sensor 202 is provided in the discharge side of the compressor 1, and a temperature sensor 203 is provided in the liquid side of the heat source side heat exchanger 4, a temperature sensor 208 is provided between the high-pressure side of the supercooling heat exchanger 13 and the indoor liquid pipes 36, a temperature sensor 213 is provided between the bypass pressure reducing mechanism 22 and the low-pressure side of the supercooling heat exchanger 13, a temperature sensor 214 is provided in the low-pressure side outlet of the supercooling heat exchanger 13. These sensors measure refrigerant temperature at the installation location.

Further, in the second heat source unit 304, a temperature sensor 204 is provided in the air inlet, and measures the outdoor air temperature.

In addition, in the accumulator 21, the liquid level detection sensor 230 is installed and detects the liquid level of the oil and a refrigerant present in the accumulator 21.

In the second heat source unit 304, a unit control device 101 is provided and the information measured by each sensor provided for the second heat source unit 304 is sent to the unit control device 101.

Operation Mode of Air-Conditioning Apparatus 300

The air-conditioning apparatus 300 performs control of each device installed on the second heat source unit 304 and the use units 303*a*, 303*b*, depending on the air-conditioning instruction requested at the use units 303*a*, 303*b*. The air-conditioning apparatus 300 can perform the cooling only operation mode and the heating only operation mode. These operation modes are called the normal operation mode.

(Normal Operation Mode: Cooling Only Operation Mode)

In the cooling only operation mode, the four-way valve 3 connects the discharge side of the compressor 1 to the gas side of the heat source side heat exchanger 4, and connects the suction side of the compressor 1 to the indoor gas pipe 37.

The high-temperature, high-pressure gas refrigerant discharged from the compressor 1 enters the heat source side heat exchanger 4 by way of the four-way valve 3, radiates heat to the outdoor air blown by the heat source side fan 5. This refrigerant, after outflowing from the heat source side heat exchanger 4, is cooled by the low-pressure refrigerant at the supercooling heat exchanger 13. This refrigerant thereafter is distributed to the refrigerant flowing in the indoor liquid pipes 36 and the bypass pressure reducing mechanism 22. The refrigerant having flowed to the indoor liquid pipes 36 are decompressed at the use side pressure reducing mechanisms 16*a*, 16 and becomes a low-pressure two-phase refrigerant, cools the indoor air in the use side heat exchangers 17*a*, 17*b* to become the low-pressure gas refrigerant. This low-pressure gas refrigerant, after outflowing from the use side heat exchangers 17*a*, 17*b*, passes through the indoor gas pipe 37 and the four-way valve 3, joins with the refrigerant having flowed in the bypass pressure reducing mechanism 22.

On the other hand, the refrigerant having entered the bypass pressure reducing mechanism 22 is decompressed at the bypass pressure reducing mechanism 22, and after becoming the low-pressure two-phase refrigerant, enters the low-pressure side of the supercooling heat exchanger 13, and is heated by the high pressure refrigerant. This refrigerant, after outflowing from the supercooling heat exchanger 13, flows in the pipe 23, and joins with the refrigerant having flowed the indoor liquid pipe 36. The joined refrigerant, after flowing to the accumulator 21, is again suctioned by the compressor 1.

(Normal Operation Mode: Heating Only Operation Mode)

In the heating only operation mode, the four-way valve 3 connects the discharge side of the compressor 1 to the indoor gas pipe 37, and connects the suction side of the compressor 1 to the gas side of the heat source side heat exchanger 4. Further, the bypass pressure reducing mechanism 22 is full-close.

The high-temperature, high-pressure gas refrigerant discharged from the compressor 1 flows in the indoor gas pipe 37 by way of the four-way valve 3, heats the indoor air in the use side heat exchangers 17*a*, 17*b* to become a high pressure liquid refrigerant. This refrigerant is thereafter decompressed at the use side pressure reducing mechanisms 16*a*, 16*b* and becomes low-pressure two-phase refrigerant, and enters the supercooling heat exchanger 13 by way of the indoor liquid pipes 36. This refrigerant absorbs heat from the outdoor air in the heat source side heat exchanger 4 to become a low-pressure gas refrigerant, and after passing the accumulator 21 by way of the four-way valve 3, is again suctioned by the compressor 1.

<Stability Determination of Accumulator 21 by Liquid Level>

The air-conditioning apparatus 300 also performs trouble diagnosis operation in the same way as the air-conditioning apparatus 100 of Embodiment 1 based on the flowchart shown in FIG. 5 and performs detection and display of the trouble portions.

Here, in step S4 of FIG. 5, the absence of movement of the liquid refrigerant from the accumulator 21 is detected by determining whether there is fluctuation in the operation safety determination value, and in Embodiment 1, the operation safety determination value is the opening degree of the pressure reducing mechanism and the degree of supercooling. On the other hand, in Embodiment 3, the liquid level detection sensor 230 is installed in the accumulator 21 so that the liquid level in the accumulator 21 can be detected.

Therefore, in Embodiment 3, the operation safety determination value is the liquid level in the accumulator 21, and where it is detected that there is no fluctuation in the liquid level (only the liquid level due to the oil is present), it is determined that there is no fluctuation in the operation safety determination value. With this configuration, it is possible to directly detect the liquid level of the liquid refrigerant present in the accumulator 21, and it becomes possible to determine the fluctuation and stability of the operational state with higher accuracy.

Accordingly, the air-conditioning apparatus 300, not only achieve the same effect as the air-conditioning apparatus 100 according to Embodiment 1, but also determine the fluctuation and a stability of the operational state with high accuracy. Of course, the content explained in Embodiment 3 may be applied to Embodiment 1 or 2. In this case, the configuration comprises a liquid level detection sensor 230 in the accumulator 21 of FIG. 1.

REFERENCE SIGNS LIST

1: compressor, 2: oil separator, 3: four-way valve, 4: heat source side heat exchanger, 5: heat source side fan, 6: fan motor, 7: check valve block, 7*a*: check valve, 7*b*: check valve, 7*c*: check valve, 7*d*: check valve, 8: high pressure pipes, 9: gas-liquid separator, 10: pipes, 11: supercooling heat exchanger, 12: liquid pressure reducing mechanism, 13: supercooling heat exchanger, 14*a*: check valve, 14*b*: check valve, 15*a*: indoor liquid branch pipes, 15*b*: indoor liquid branch pipes, 16*a*: use side pressure reducing mechanism, 16*b*: use side pressure reducing mechanism, 17*a*: use side heat exchanger, 17*b*: use side heat exchanger, 18*a*: indoor gas branch pipes, 18*b*: indoor gas branch pipes, 19*a*: solenoid valve, 19*b*: solenoid valve, 20: low-pressure pipes, 21: accumulator, 22: bypass pressure reducing mechanism, 23: pipes, 24: pipes, 25: pipes, 26*a*: solenoid valve, 26*b*: solenoid valve, 27*a*: check valve, 27*b*: check valve, 28: pipes, 29: solenoid valve, 30: capillary, 31: pipes, 35: compressor invertor, 36: indoor liquid pipes, 37: indoor gas pipe, 100: air-conditioning apparatus, 101: unit control device, 102: measurement unit, 103: control computation unit, 104: control unit, 105: unit communication unit, 121: controller control device, 122: input unit, 123: external communication unit, 124: diagnostic operation instruction unit, 125: memory unit, 126: diagnosis computation unit, 127: determination unit, 128: display unit, 201: pressure sensor, 202: temperature sensor, 203: temperature sensor, 204: temperature sensor, 205: temperature sensor, 206: pressure sensor, 207: pressure sensor, 208: temperature sensor, 209*a*: temperature sensor, 209*b*: temperature sensor, 210*a*: temperature sensor, 210*b*: temperature sensor, 211*a*: temperature sensor, 211*b*: temperature sensor, 212: pressure sensor, 213: temperature sensor, 214: temperature sensor, 215: temperature sensor, 230: liquid level detection sensor, 300: air-conditioning apparatus, 301: heat source unit, 302: relay unit, 303: use unit, 303*a*: use unit, 303*b*: use unit, 304: second heat source unit, 320: external controller, a: junction point, b: junction point, c: junction point, d: junction point

The invention claimed is:

1. An air-conditioning apparatus comprising:

a refrigerant circuit in which a compressor, a heat source side heat exchanger, a use side pressure reducing mechanism, a use side heat exchanger are connected by a pipe such that a refrigerant circulates therearound;

at least one of a temperature sensor that detects a refrigerant temperature and a pressure sensor that detects a refrigerant pressure;

a controller control device that includes a diagnostic operation instruction unit that instructs execution of a trouble diagnosis operation for specifying a trouble of the air-conditioning apparatus, and a determination unit that determines presence or absence of the trouble; and a unit control device including a control unit that controls each of a plurality of component devices of the refrigerant circuit during the trouble diagnosis operation, wherein the control unit is configured to perform both of a response detection diagnosis mode and a performance detection diagnosis mode during the trouble diagnosis operation, the diagnosis modes including:

in the response detection diagnosis mode, the control unit forcibly changes an operation of at least one of the plurality of component devices and detects a trouble in a case where a change in a detection value of the at least one of the temperature sensor and the pressure sensor is within a predetermined range of value, or a magnitude of the change in the detection value is equal to or smaller than a threshold value, and in the performance detection diagnosis mode, the control unit detects a trouble based on a detection value of the at least one of the temperature sensor and the pressure sensor in a case where an operational state of the refrigerant circuit in the trouble diagnosis operation is stable, wherein the performance detection diagnosis mode is executed after the response detection diagnosis mode is executed, and the control unit sets an operation frequency of the compressor in the performance detection diagnosis mode to be greater than an operation frequency of the compressor in the response detection diagnosis mode.

2. The air-conditioning apparatus of claim 1, further comprising:

a compressor invertor that changes an operation frequency of the compressor;

a heat source side fan that blows air to the heat source side heat exchanger;

a fan motor that changes a rotation speed by driving the heat source side fan;

a solenoid valve provided in at least a part of the pipe; and a memory unit that stores information on to which of a plurality of branching ports each of a plurality of the use side heat exchangers and the use side pressure reducing mechanisms, the plurality of use side heat exchangers and use side pressure reducing mechanisms being connected by piping in parallel through the respective branching ports, is connected, wherein a trouble diagnosed by the response detection diagnosis mode is at least any one of sensor drop-off, pressure reducing mechanism lock, solenoid valve lock, a compressor inverter defect, a fan motor defect, and a branching port setting error, and a trouble diagnosed by the performance detection diagnosis mode is at least any one of pipe clogging, compressor efficiency deterioration, heat exchanger contamination and insufficient amount of refrigerant.

3. The air-conditioning apparatus of claim 1, wherein the control unit fixes the operation frequency of the compressor during the trouble diagnosis operation, fixes a rotation speed of the heat source side fan during the trouble diagnosis operation based on an outdoor air temperature and the operation frequency of the compressor; and performs control of an opening degree of the use side pressure reducing mechanism such that an operational state detected by the at least one of the temperature sensor and the pressure sensor takes a predetermined value.

4. The air-conditioning apparatus of claim 1, wherein the determination unit, by using a degree of supercooling at a position in a range from the compressor to the use side pressure reducing mechanism and an opening degree of at least one pressure reducing mechanism installed in the refrigerant circuit, as at least one stability determination index for determining an operational state to be stable, determines that the operational state is stable where fluctuation of the at least one stability determination index is within a predetermined range of value, and executes the performance detection diagnosis mode.

5. The air-conditioning apparatus of claim 1, further comprising:

a unit communication unit that outputs an abnormality signal representing an abnormal condition to outside, the unit communication unit being provided in the unit control device, and an external communication unit that receives an output signal from the unit communication unit, the external communication unit being provided in the controller control device, wherein the diagnostic operation instruction unit specifies a portion on which the trouble is diagnosed based on the abnormality signal.

6. The air-conditioning apparatus of claim 1, wherein the operation instruction unit repeatedly executes trouble diagnosis until the determination unit determines that there is no trouble in the response detection diagnosis mode or the performance detection diagnosis mode.

7. The air-conditioning apparatus of claim 1, further comprising:

a liquid receiver installed in a suction side of the compressor;

a liquid level detection sensor installed in the liquid receiver, and detecting a liquid level in the liquid receiver, wherein the determination unit, by using a liquid level detected by the liquid level detection sensor as at least one stability determination index for determining an operational state as stable, determines that the operational state is stable where the fluctuation of the at least one stability determination index is within a predetermined range of value, and executes the performance detection diagnosis mode.

8. The air-conditioning apparatus of claim 1, wherein the controller control device further comprises a display unit that displays presence or absence of the trouble regarding a diagnostic mode diagnosed in the trouble diagnosis operation.

9. The air-conditioning apparatus of claim 1, wherein the performance detection diagnosis mode detects the trouble based on the detection value of the at least one of the temperature sensor and the pressure sensor, when the operational state of the trouble diagnosis operation is determined to be returned to stable after execution of the response detection diagnosis mode.

10. The air-conditioning apparatus of claim 1, wherein the control unit is further configured to perform the control of each of the plurality of component devices during the trouble diagnosis operation, responsive to receipt of an instruction from the controller control device that instructs the execution of the trouble diagnosis operation, and perform both of the response detection diagnosis mode and the performance detection diagnosis mode during the trouble diagnosis operation, wherein the performance detection diagnosis mode is executed, and then the air-conditioning apparatus stands by until an operational state of the air-conditioning apparatus is stabilized, and then the response detection diagnosis mode is executed.

* * * * *